US006691084B2

(12) United States Patent
Manjunath et al.

(10) Patent No.: US 6,691,084 B2
(45) **Date of Patent: *Feb. 10, 2004**

(54) MULTIPLE MODE VARIABLE RATE SPEECH CODING

(75) Inventors: Sharath Manjunath, San Diego, CA (US); William Gardner, San Diego, CA (US)

(73) Assignee: Qualcomm Incorporated, San Diego, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/217,341

(22) Filed: Dec. 21, 1998

(65) Prior Publication Data

US 2002/0099548 A1 Jul. 25, 2002

(51) Int. Cl.[7] ..... G10L 19/12; G10L 21/00; G10L 19/14

(52) U.S. Cl. ..... 704/221; 704/201; 704/220; 704/214; 704/223

(58) Field of Search ..... 704/219, 220–221, 704/226–228, 230, 206, 214, 205

(56) References Cited

U.S. PATENT DOCUMENTS

| | | | |
|---|---|---|---|
| 3,633,107 A | 1/1972 | Brady | 325/305 |
| 4,012,595 A | 3/1977 | Ota | 179/15 |
| 4,076,958 A | 2/1978 | Fulghum | 179/1.5 A |
| 4,214,125 A | 7/1980 | Mozer et al. | 179/1 SM |
| 4,360,708 A | 11/1982 | Taguchi et al. | 179/15.55 |
| 4,535,472 A | 8/1985 | Tomcik | 381/31 |
| 4,610,022 A | 9/1986 | Kitayama et al. | 380/36 |
| 4,672,669 A | 6/1987 | DesBlache et al. | 381/46 |

(List continued on next page.)

FOREIGN PATENT DOCUMENTS

WO 0718822 12/1994

OTHER PUBLICATIONS

DeMartin ("Mixed–Domain Coding of Speech at 3 KB/S," Conference on Acoustics, Speech & Signal Processing, May 1996).*

(List continued on next page.)

*Primary Examiner*—Richemond Dorvil
*Assistant Examiner*—Daniel Nolan
(74) *Attorney, Agent, or Firm*—Philip R. Wadsworth; Charles D. Brown; Kyung H. Macek

(57) ABSTRACT

A method and apparatus for the variable rate coding of a speech signal. An input speech signal is classified and an appropriate coding mode is selected based on this classification. For each classification, the coding mode that achieves the lowest bit rate with an acceptable quality of speech reproduction is selected. Low average bit rates are achieved by only employing high fidelity modes (i.e., high bit rate, broadly applicable to different types of speech) during portions of the speech where this fidelity is required for acceptable output. Lower bit rate modes are used during portions of speech where these modes produce acceptable output. Input speech signal is classified into active and inactive regions. Active regions are further classified into voiced, unvoiced, and transient regions. Various coding modes are applied to active speech, depending upon the required level of fidelity. Coding modes may be utilized according to the strengths and weaknesses of each particular mode. The apparatus dynamically switches between these modes as the properties of the speech signal vary with time. And where appropriate, regions of speech are modeled as pseudo-random noise, resulting in a significantly lower bit rate. This coding is used in a dynamic fashion whenever unvoiced speech or background noise is detected.

4 Claims, 23 Drawing Sheets

U.S. PATENT DOCUMENTS

| | | | | | |
|---|---|---|---|---|---|
| 4,672,670 | A | | 6/1987 | Wang et al. | 381/47 |
| 4,677,671 | A | | 6/1987 | Galand et al. | 381/31 |
| RE32,580 | E | | 1/1988 | Atal et al. | 381/40 |
| 4,764,963 | A | * | 8/1988 | Atal | 704/219 |
| 4,771,465 | A | | 9/1988 | Bronson et al. | 381/36 |
| 4,797,925 | A | | 1/1989 | Lin | 381/36 |
| 4,797,929 | A | | 1/1989 | Gerson et al. | 381/43 |
| 4,827,517 | A | | 5/1989 | Atal et al. | 381/41 |
| 4,843,612 | A | | 6/1989 | Brusch et al. | 375/1 |
| 4,852,179 | A | | 7/1989 | Fette | 381/29 |
| 4,856,068 | A | | 8/1989 | Quatieri, Jr. et al. | 381/47 |
| 4,864,561 | A | | 9/1989 | Ashenfelter et al. | 370/81 |
| 4,885,790 | A | | 12/1989 | McAulay et al. | 381/36 |
| 4,890,327 | A | | 12/1989 | Bertrand et al. | 381/38 |
| 4,896,361 | A | | 1/1990 | Gerson | 381/40 |
| 4,899,384 | A | | 2/1990 | Crouse et al. | 381/31 |
| 4,899,385 | A | | 2/1990 | Ketchum et al. | 381/36 |
| 4,918,734 | A | | 4/1990 | Muramatsu et al. | 381/46 |
| 4,933,957 | A | | 6/1990 | Bottau et al. | 375/27 |
| 4,937,873 | A | | 6/1990 | McAulay et al. | 381/51 |
| 4,965,789 | A | | 10/1990 | Bottau et al. | 370/79 |
| 5,023,910 | A | | 6/1991 | Thomson | 381/37 |
| 5,054,072 | A | | 10/1991 | McAulay et al. | 381/31 |
| 5,140,638 | A | | 8/1992 | Moulsley et al. | 381/36 |
| 5,222,189 | A | | 6/1993 | Fielder | 395/2 |
| 5,414,796 | A | | 5/1995 | Jacobs et al. | 395/2.3 |
| 5,459,814 | A | * | 10/1995 | Gupta et al. | 704/226 |
| 5,495,555 | A | * | 2/1996 | Swaminathan | 704/207 |
| 5,548,680 | A | * | 8/1996 | Cellario | 704/219 |
| 5,596,676 | A | * | 1/1997 | Swaminathan et al. | 704/208 |
| 5,657,418 | A | * | 8/1997 | Gerson et al. | 704/207 |
| 5,734,789 | A | * | 3/1998 | Swaminathan et al. | 704/223 |
| 5,812,965 | A | * | 9/1998 | Massaloux | 704/228 |
| 5,884,252 | A | * | 3/1999 | Ozawa | 704/220 |
| 5,884,253 | A | * | 3/1999 | Kleijn | 704/219 |
| 5,890,108 | A | * | 3/1999 | Yeldener | 704/208 |
| 5,909,663 | A | * | 6/1999 | Iijima et al. | 704/220 |
| 5,911,128 | A | * | 6/1999 | DeJaco | 704/221 |
| 5,933,802 | A | * | 8/1999 | Emori | 704/219 |
| 5,956,673 | A | * | 9/1999 | Weaver, Jr. et al. | 704/221 |
| 5,995,923 | A | * | 11/1999 | Mermelstein et al. | 704/219 |
| 6,205,423 | B1 | * | 3/2001 | Su et al. | 704/220 |
| 6,240,386 | B1 | * | 5/2001 | Thyssen et al. | 704/220 |

OTHER PUBLICATIONS

"M–LCELP speech coding at 4 kbps", Ozawa, K.; Serizawa, M.; Miyano, T.; Nomura, T., International Conference on Acoustics, Speech, and Signal Processing, Apr. 1994.*

Lupini, et al. "A Multi–Mode Variable Rate CELP Coder Based on Frame Classification" Proceedings of the Int'l Conf. On Communications 1:406–409 (1993).

Paksoy, et al. "Variable Rate Speech Coding for Multiple Access Wireless Networks" Prceedings of the Mediterranean Electrotechnical Conf. 1:47–50 (1994).

Atal et al., "Adaptive Predictive Coding of Speech Signals", *The Bell System Technical Journal*, Oct. 1970, pp. 1973–1986.

Schroeder et al. "Stochastic Coding of Speech Signals at Very Low Bit Rates: The Importance of Speech Perception," *Speech Communication 4* (1985), pp. 155–162.

Schroeder et al. "Code–Excited Linear Prediction (CELP): High–Quality Speech at Very Low Bit Rates," *1985 IEEE Communications*, pp. 937–940 (25.1.1–25.1.4).

Bishnu S. Atal. "Predictive Coding of Speech at Low Bit RAtes", *IEEE Transactions on Communications*, vol. Com–30, No. 4, Apr. 1982, pp. 600–614.

Singhai et al. "Improving Performance of Multi–Pulse LPC Coders at Low Bit Rates", *IEEE Transactions on Communications*, 1984, pp. 1.3.1–1.3.4.

Atal et al. "Stochastic Coding of Speech Signals at Very Low Bit Rates," *1984 IEEE*, pp. 1610–1613.

Wang et al. "Phonetically–Based Vector Excitation Coding of Speech at 3.6 kbps," *1989 IEEE*, pp. 49–52.

Rabiner et al., "Linear Predictive Coding of Speech", 1978 *Digital Processing of Speech Signals*, pp. 411–413.

T. Tremain et al., "A 4.8 KBPS Code Excited Linear Predictive Coder", 1988 *Proceedings of the Mobile Satellite Conference*, pp. 491–496.

W. Bastiaan Kleijn et al., "Methods for Waveform Interpolation in Speech Coding", 1991 *Digital Signal Processing*, pp. 215–230.

Paul Mennen, "DSP Chips Can Produce Random Numbers Using Proven Algorithm", *EDN*, Jan. 21, 1991, pp. 141–145.

N.S. Jayant, "Variable Rate Speech Coding: A Review", *1984 IEEE*, pp. 1614–1617.

R. DiFrancesco et al., "Variable Rate Speech Coding With Online Segmentation and Fast Algebraic Codes", *1990 IEEE*, pp. 233–236.

Saeed V. Vaseghi, "Finite State CELP for Variable Rate Speech Coding", *1990 IEEE*, pp. 37–40.

H. Nakada et al., "Variable Rate Speech Coding for Asynchronous Transfer Mode", *IEEE Transaction on Communications*, vol. 38, No. 3, Mar. 1990, pp. 277–284.

* cited by examiner

MULTIPLE MODE VARIABLE RATE SPEECH CODING

BACKGROUND OF THE INVENTION

I. Field of the Invention

The present invention relates to the coding of speech signals. Specifically, the present invention relates to classifying speech signals and employing one of a plurality of coding modes based on the classification.

II. Description of the Related Art

Many communication systems today transmit voice as a digital signal, particularly long distance and digital radio telephone applications. The performance of these systems depends, in part, on accurately representing the voice signal with a minimum number of bits. Transmitting speech simply by sampling and digitizing requires a data rate on the order of 64 kilobits per second (kbps) to achieve the speech quality of a conventional analog telephone. However, coding techniques are available that significantly reduce the data rate required for satisfactory speech reproduction.

The term "vocoder" typically refers to devices that compress voiced speech by extracting parameters based on a model of human speech generation. Vocoders include an encoder and a decoder. The encoder analyzes the incoming speech and extracts the relevant parameters. The decoder synthesizes the speech using the parameters that it receives from the encoder via a transmission channel. The speech signal is often divided into frames of data and block processed by the vocoder.

Vocoders built around linear-prediction-based time domain coding schemes far exceed in number all other types of coders. These techniques extract correlated elements from the speech signal and encode only the uncorrelated elements. The basic linear predictive filter predicts the current sample as a linear combination of past samples. An example of a coding algorithm of this particular class is described in the paper "A 4.8 kbps Code Excited Linear Predictive Coder," by Thomas E. Tremain et al., Proceedings of the Mobile Satellite Conference, 1988.

These coding schemes compress the digitized speech signal into a low bit rate signal by removing all of the natural redundancies (i e., correlated elements) inherent in speech. Speech typically exhibits short term redundancies resulting from the mechanical action of the lips and tongue, and long term redundancies resulting from the vibration of the vocal cords. Linear predictive schemes model these operations as filters, remove the redundancies, and then model the resulting residual signal as white gaussian noise. Linear predictive coders therefore achieve a reduced bit rate by transmitting filter coefficients and quantized noise rather than a full bandwidth speech signal.

However, even these reduced bit rates often exceed the available bandwidth where the speech signal must either propagate a long distance (e.g. ground to satellite) or coexist with many other signals in a crowded channel. A need therefore exists for an improved coding scheme which achieves a lower bit rate than linear predictive schemes.

SUMMARY OF THE INVENTION

The present invention is a novel and improved method and apparatus for the variable rate coding of a speech signal. The present invention classifies the input speech signal and selects an appropriate coding mode based on this classification. For each classification, the present invention selects the coding mode that achieves the lowest bit rate with an acceptable quality of speech reproduction. The present invention achieves low average bit rates by only employing high fidelity modes (i.e., high bit rate, broadly applicable to different types of speech) during portions of the speech where this fidelity is required for acceptable output. The present invention switches to lower bit rate modes during portions of speech where these modes produce acceptable output.

An advantage of the present invention is that speech is coded at a low bit rate. Low bit rates translate into higher capacity, greater range, and lower power requirements.

A feature of the present invention is that the input speech signal is classified into active and inactive regions. Active regions are further classified into voiced, unvoiced, and transient regions. The present invention therefore can apply various coding modes to different types of active speech, depending upon the required level of fidelity.

Another feature of the present invention is that coding modes may be utilized according to the strengths and weaknesses of each particular mode. The present invention dynamically switches between these modes as properties of the speech signal vary with time.

A further feature of the present invention is that, where appropriate, regions of speech are modeled as pseudo-random noise, resulting in a significantly lower bit rate. The present invention uses this coding in a dynamic fashion whenever unvoiced speech or background noise is detected.

The features, objects, and advantages of the present invention will become more apparent from the detailed description set forth below when taken in conjunction with the drawings in which like reference numbers indicate identical or functionally similar elements. Additionally, the left-most digit of a reference number identifies the drawing in which the reference number first appears.

DETAILED DESCRIPTION OF THE PREFERRED EMBODIMENTS

Figure 1:
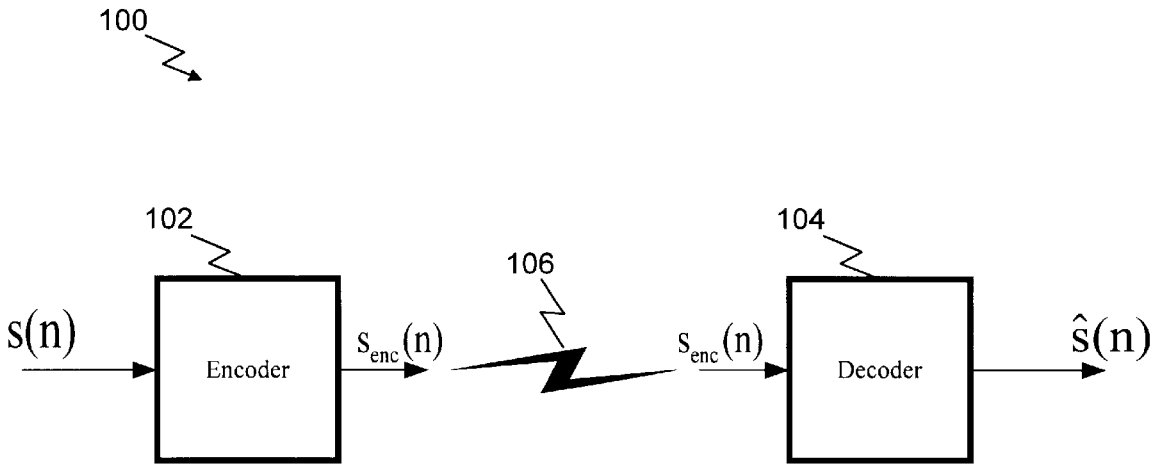
FIG. 1 is a diagram illustrating a signal transmission environment.

I. Overview of the Environment
II. Overview of the Invention
III. Initial Parameter Determination
A. Calculation of LPC Coefficients
B. LSI Calculation
C. NACF Calculation
D. Pitch Track and Lag Calculation
E. Calculation of Band Energy and Zero Crossing Rate
F. Calculation of the Formant Residual
IV. Active/Inactive Speech Classification
A. Hangover Frames
V. Classification of Active Speech Frames
VI. Encoder/Decoder Mode Selection
VII. Code Excited Linear Prediction (CELP) Coding Mode
A. Pitch Encoding Module
B. Encoding codebook
C. CELP Decoder
D. Filter Update Module
VIII. Prototype Pitch Period (PPP) Coding Mode
A. Extraction Module
B. Rotational Correlator
C. Encoding Codebook
D. Filter Update Module
E. PPP Decoder
F. Period Interpolator
IX. Noise Excited Linear Prediction (NELP) Coding Mode
X. Conclusion I. Overview of the Environment The present invention is directed toward novel and improved methods and apparatuses for variable rate speech coding. FIG. 1 depicts a signal transmission environment 100 including an encoder 102, adecoder 104, and a transmission medium 106. Encoder 102 encodes a speech signal s(n), forming encoded speech signal $s_{enc}(n)$, for transmission across transmission medium 106 to decoder 104. Decoder 104 decodes $s_{enc}(n)$, thereby generating synthesized speech signal $\hat{s}(n)$.

The term "coding" as used herein refers generally to methods encompassing both encoding and decoding. Generally, coding methods and apparatuses seek to minimize the number of bits transmitted via transmission medium 106 (i.e., minimize the bandwidth of $S_{enc}(n)$) while maintaining acceptable speech reproduction (i.e., $\hat{s}(n) \approx s(n)$). The composition of the encoded speech signal will vary according to the particular speech coding method. Various encoders 102, decoders 104, and the coding methods according to which they operate are described below.

The components of encoder 102 and decoder 104 described below may be implemented as electronic hardware, as computer software, or combinations of both. These components are described below in terms of their functionality. Whether the functionality is implemented as hardware or software will depend upon the particular application and design constraints imposed on the overall system. Skilled artisans will recognize the interchangeability of hardware and software under these circumstances, and how best to implement the described functionality for each particular application.

Those skilled in the art will recognize that transmission medium 106 can represent many different transmission media, including, but not limited to, a land-based communication line, a link between a base station and a satellite, wireless communication between a cellular telephone and a base station, or between a cellular telephone and a satellite.

Those skilled in the art will also recognize that often each party to a communication transmits as well as receives. Each party would therefore require an encoder 102 and a decoder 104. However, signal tranmission environment 100 will be described below as including encoder 102 at one end of transmission medium 106 and decoder 104 at the other. Skilled artisans will readily recognize how to extend these ideas to two-way communication.

For purposes of this description, assume that s(n) is a digital speech signal obtained during a typical conversation including different vocal sounds and periods of silence. The speech signal s(n) is preferably partitioned into frames, and each frame is further partitioned into subframes (preferably 4). These arbitrarily chosen frame/subframe boundaries are commonly used where some block processing is performed, as is the case here. Operations described as being performed on frames might also be performed on subframes—in this sense, frame and subframe are used interchangeably herein. However, s(n) need not be partitioned into frames/subframes at all if continuous processing rather than block processing is implemented. Skilled artisans will readily recognize how the block techniques described below might be extended to continuous processing.

In a preferred embodiment, s(n) is digitally sampled at 8 kHz. Each frame preferably contains 20 ms of data, or 160 samples at the preferred 8 kHz rate. Each subframe therefore contains 40 samples of data. It is important to note that many of the equations presented below assume these values. However, those skilled in the art will recognize that while these parameters are appropriate for speech coding, they are merely exemplary and other suitable alternative parameters could be used.

II. Overview of the Invention

Figure 2:
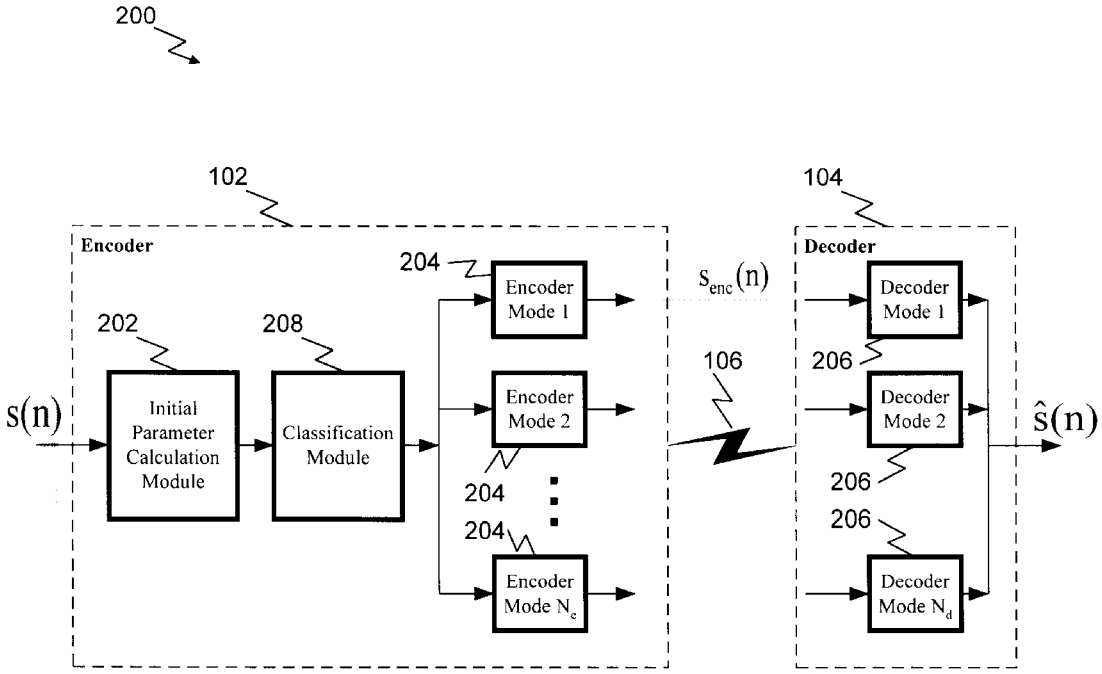
FIG. 2 is a diagram illustrating encoder 102 and decoder 104 in greater detail.

The methods and apparatuses of the present invention involve coding the speech signal s(n). FIG. 2 depicts encoder 102 and decoder 104 in greater detail. According to the present invention, encoder 102 includes an initial parameter calculation module 202, a classification module 208, and one or more encoder modes 204. Decoder 104 includes one or more decoder modes 206. The number of decoder modes, $N_d$, in general equals the number of encoder modes, $N_e$. As would be apparent to one skilled in the art, encoder mode 1 communicates with decoder mode 1, and so on. As shown, the encoded speech signal, $S_{enc}(n)$, is transmitted via transmission medium 106.

In a preferred embodiment, encoder 102 dynamically switches between multiple encoder modes from frame to frame, depending on which mode is most appropriate given the properties of s(n) for the current frame. Decoder 104 also dynamically switches between the corresponding decoder modes from frame to frame. A particular mode is chosen for each frame to achieve the lowest bit rate available while maintaining acceptable signal reproduction at the decoder. This process is referred to as variable rate speech coding, because the bit rate of the coder changes over time (as properties of the signal change).

Figure 3:
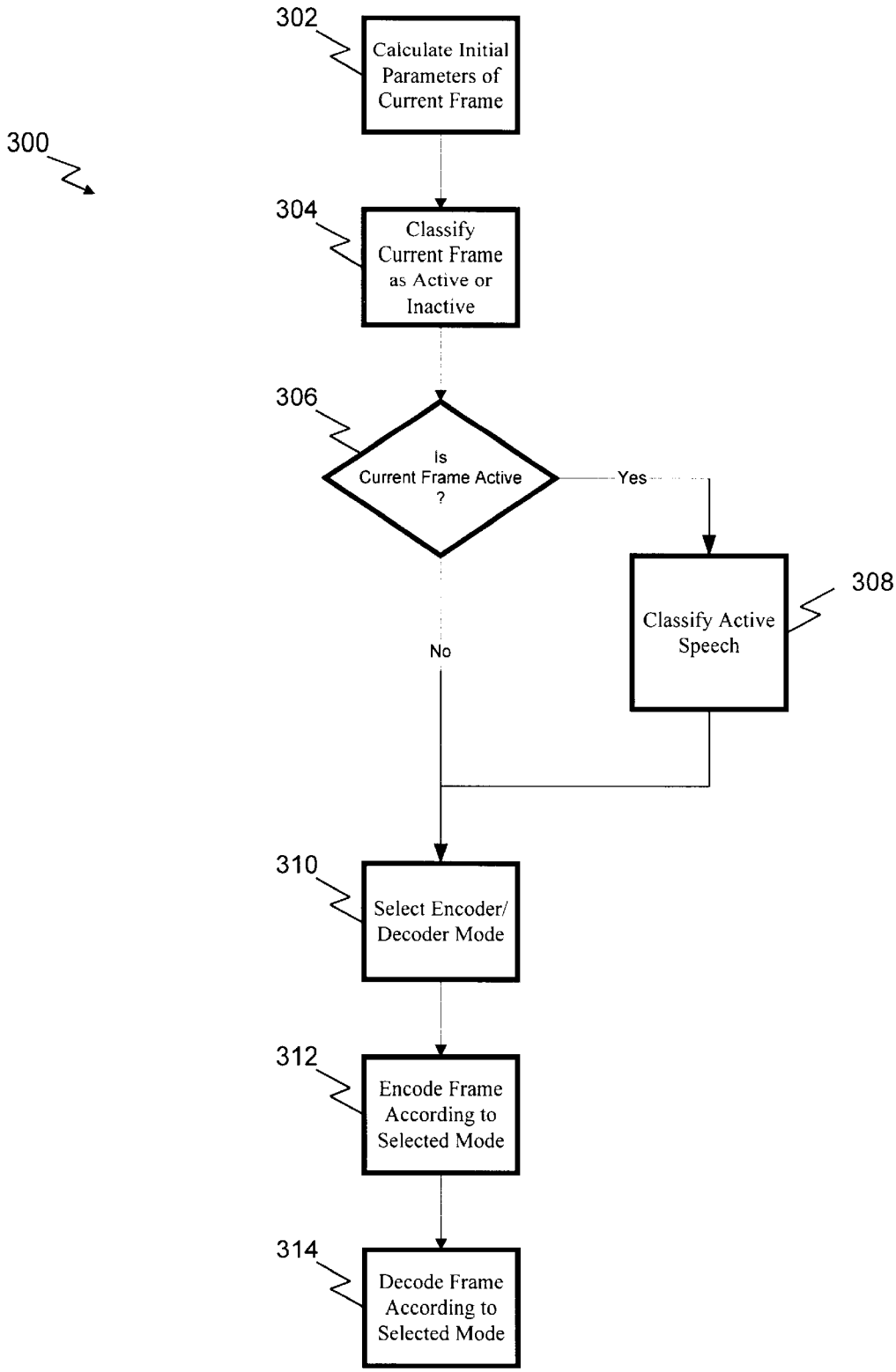
FIG. 3 is a flowchart illustrating variable rate speech coding according to the present invention.

FIG. 3 is a flowchart 300 that describes variable rate speech coding according to the present invention. In step 302, initial parameter calculation module 202 calculates various parameters based on the current frame of data. In a preferred embodiment, these parameters include one or more of the following: linear predictive coding (LPC) filter coefficients, line spectruminformation (LSI) coefficients, the normalized autocorrelation functions (NACFs), the open loop lag, band energies, the zero crossing rate, and the formant residual signal.

In step 304, classification module 208 classifies the current frame as containing either "active" or "inactive" speech. As described above, s(n) is assumed to include both periods of speech and periods of silence, common to an ordinary conversation. Active speech includes spoken words, whereas inactive speech includes everything else, e.g., background noise, silence, pauses. The methods used to classify speech as active/inactive according to the present invention are described in detail below.

As shown in FIG. 3, step 306 considers whether the current frame was classified as active or inactive in step 304. If active, control flow proceeds to step 308. If inactive, control flow proceeds to step 310.

Those frames which are classified as active are further classified in step 308 as either voiced, unvoiced, or transient frames. Those skilled in the art will recognize that human speech can be classified in many different ways. Two conventional classifications of speech are voiced and unvoiced sounds. According to the present invention, all speech which is not voiced or unvoiced is classified as transient speech.

Figure 4A:
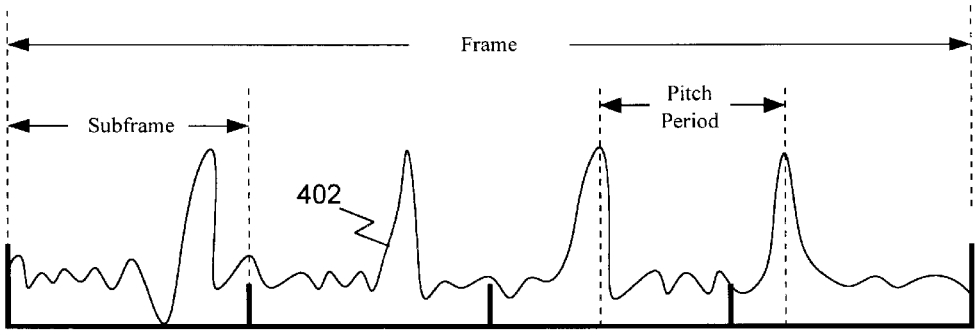
FIG. 4A is a diagram illustrating a frame of voiced speech split into subframes.

FIG. 4A depicts an example portion of s(n) including voiced speech 402. Voiced sounds are produced by forcing air through the glottis with the tension of the vocal cords adjusted so that they vibrate in a relaxed oscillation, thereby producing quasi-periodic pulses of air which excite the vocal tract. One common property measured in voiced speech is the pitch period, as shown in FIG. 4A.

Figure 4B:
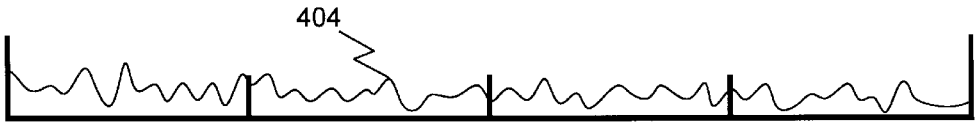
FIG. 4B is a diagram illustrating a frame of unvoiced speech split into subframes.

FIG. 4B depicts an example portion of s(n) including unvoiced speech 404. Unvoiced sounds are generated by forming a constriction at some point in the vocal tract (usually toward the mouth end), and forcing air through the constriction at a high enough velocity to produce turbulence. The resulting unvoiced speech signal resembles colored noise.

Figure 4C:
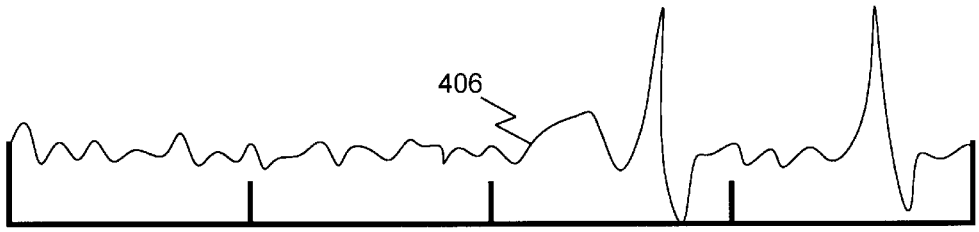
FIG. 4C is a diagram illustrating a frame of transient speech split into subframes.

FIG. 4C depicts an example portion of s(n) including transient speech 406 (i.e., speech which is neither voiced nor unvoiced). The example transient speech 406 shown in FIG. 4C might represent s(n) transitioning between unvoiced speech and voiced speech. Skilled artisans will recognize that many different classifications of speech could be employed according to the techniques described herein to achieve comparable results.

In step 310, an encoder/decoder mode is selected based on the frame classification made in steps 306 and 308. The various encoder/decoder modes are connected in parallel, as shown in FIG. 2. One or more of these modes can be operational at any given time. However, as described in detail below, only one mode preferably operates at any given time, and is selected according to the classification of the current frame.

Several encoder/decoder modes are described in the following sections. The different encoder/decoder modes operate according to different coding schemes. Certain modes are more effective at coding portions of the speech signal s(n) exhibiting certain properties.

In a preferred embodiment, a "Code Excited Linear Predictive" (CELP) mode is chosen to code frames classified as transient speech. The CELP mode excites a linear predictive vocal tract model with a quantized version of the linear prediction residual signal. Of all the encoder/decoder modes described herein, CELP generally produces the most accurate speech reproduction but requires the highestbit rate. In one embodiment, the CELP mode performs encoding at 8500 bits per second.

A "Prototype Pitch Period" (PPP) mode is preferably chosen to code frames classified as voiced speech. Voiced speech contains slowly time varying periodic components which are exploited by the PPP mode. The PPP mode codes only a subset of the pitch periods within each frame. The remaining periods of the speech signal are reconstructed by interpolating between these prototype periods. By exploiting the periodicity of voiced speech, PPP is able to achieve a lower bit rate than CELP and still reproduce the speech signal in a perceptually accurate manner. In one embodiment, the PPP mode performs encoding at 3900 bits per second.

A "Noise Excited Linear Predictive" (NELP) mode is chosen to code frames classified as unvoiced speech. NELP uses a filtered pseudo-random noise signal to model unvoiced speech. NELP uses the simplest model for the coded speech, and therefore achieves the lowest bit rate. In one embodiment, the NELP mode performs encoding at 1500 bits per second.

The same coding technique can frequently be operated at different bit rates, with varying levels of performance. The different encoder/decoder modes in FIG. 2 can therefore represent different coding techniques, or the same coding technique operating at different bit rates, or combinations of the above. Skilled artisans will recognize that increasing the number of encoder/decoder modes will allow greater flexibility when choosing a mode, which can result in a lower average bit rate, but will increase complexity within the overall system. The particular combination used in any given system will be dictated by the available system resources and the specific signal environment.

In step 312, the selected encoder mode 204 encodes the current frame and preferably packs the encoded data into data packets for transmission. And in step 314, the corresponding decoder mode 206 unpacks the data packets, decodes the received data and reconstructs the speech signal. These operations are described in detail below with respect to the appropriate encoder/decoder modes.

III. Initial Parameter Determination

Figure 5:
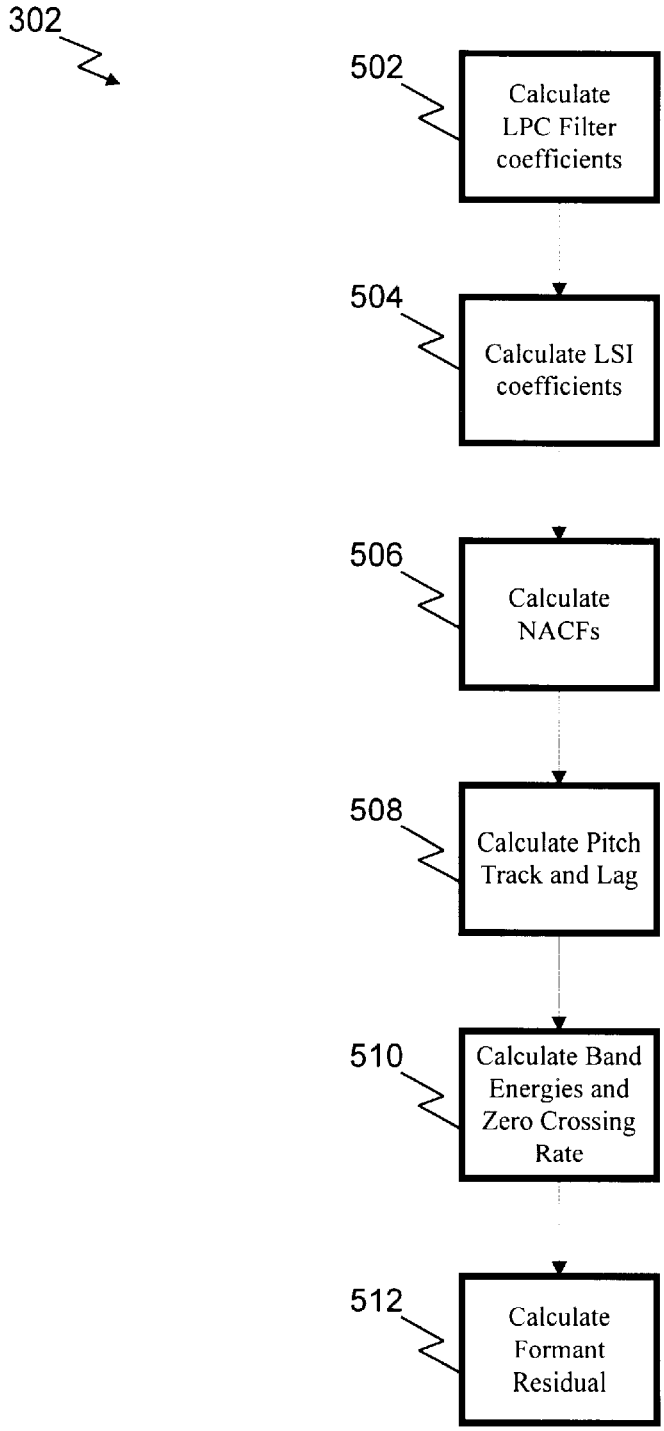
FIG. 5 is a flowchart that describes the calculation of initial parameters.

FIG. 5 is a flowchart describing step 302 in greater detail. Various initial parameters are calculated according to the present invention. The parameters preferably include, e.g., LPC coefficients, line spectrum information (LSI) coefficients, normalized autocorrelation functions (NACFs), open loop lag, band energies, zero crossing rate, and the formant residual signal. These parameters are used in various ways within the overall system, as described below.

In a preferred embodiment, initial parameter calculation module 202 uses a "look ahead" of 160+40 samples. This serves several purposes. First, the 160 sample look ahead allows a pitch frequency track to be computed using information in the next frame, which significantly improves the robustness of the voice coding and the pitch period estimation techniques, described below. Second, the 160 sample look ahead also allows the LPC coefficients, the frame energy, and the voice activity to be computed for one frame in the future. This allows for efficient, multi-frame quantization of the frame energy and LPC coefficients. Third, the additional 40 sample look ahead is for calculation of the LPC coefficients on Hamming windowed speech as described below. Thus the number of samples buffered before processing the current frame is 160+160+40 which includes the current frame and the 160+40 sample look ahead.

A. Calculation of LPC Coefficients

The present invention utilizes an LPC prediction error filter to remove the short term redundancies in the speech signal. The transfer function for the LPC filter is:

$$A(z) = 1 - \sum_{i=1}^{10} a_i z^{-i}$$

The present invention preferably implements a tenth-order filter, as shown in the previous equation. An LPC synthesis filter in the decoder reinserts the redundancies, and is given by the inverse of A(z):

$$\frac{1}{A(z)} = \frac{1}{1 - \sum_{i=1}^{10} a_i z^{-i}}$$

In step 502, the LPC coefficients, $\alpha_i$, are computed from s(n) as follows. The LPC parameters are preferably computed for the next frame during the encoding procedure for the current frame.

A Hamming window is applied to the current frame centered between the $119^{th}$ and $120^{th}$ samples (assuming the preferred 160 sample frame with a "look ahead"). The windowed speech signal, $s_w(n)$ is given by:

$$s_w(n) = s(n+40)\left(0.5 + 0.46 * \cos\left(\pi \frac{n - 79.5}{80}\right)\right),\ 0 \le n < 160$$

The offset of 40 samples results in the window of speech being centered between the $119^{th}$ and $120^{th}$ sample of the preferred 160 sample frame of speech.

Eleven autocorrelation values are preferably computed as $$R(k) = \sum_{m=0}^{159-k} s_w(m) s_w(m+k),\ 0 \le k \le 10$$

The autocorrelation values are windowed to reduce the probability of missing roots of line spectral pairs (LSPs) obtained from the LPC coefficients, as given by:

$$R(k) = h(k)R(k),\ 0 \leqq k \leqq 10$$

resulting in a slight bandwidth expansion, e.g., 25 Hz. The values h(k) are preferably taken from the center of a 255 point Hamming window.

The LPC coefficients are then obtained from the windowed autocorrelation values using Durbin's recursion. Durbin's recursion, a well known efficient computational method, is discussed in the text Digital Processing of Speech Signals by Rabiner & Schafer.

B. LSI Calculation

In step 504, the LPC coefficients are transformed into line spectrum information (LSI) coefficients for quantization and interpolation. The LSI coefficients are computed according to the present invention in the following manner.

As before, A(z) is given by $$A(z) = 1 - \alpha_1 z^{-1} - \ldots - \alpha_{10} z^{-10},$$

where $\alpha_1$ are the LPC coefficients, and $1 \leqq i \leqq 10$.

$P_A(z)$ and $Q_A(z)$ are defined as the following $$P_A(z) = A(z) + z^{-11}A(z^{-1}) = p_0 + p_1 z^{-1} + \ldots + p_{11} z^{-11},$$

$$Q_A(z) = A(z) - z^{-11}A(z^{-1}) = q_0 + q_1 z^{-1} + \ldots + q_{11} z^{-11},$$

where $$p_i = -\alpha_i - \alpha_{11-i},\ 1 \leqq i \leqq 10$$

$$q_i = -\alpha_i + \alpha_{11-i},\ 1 \leqq i \leqq 10$$

and $$p_0 = 1\ p_{11} = 1$$

$$q_0 = 1\ q_{11} = -1$$

The line spectral cosines (LSCs) are the ten roots in $-1.0 < x < 1.0$ of the following two functions:

$$P'(x) = p'_o \cos(5 \cos^{-1}(x)) + p'_1(4 \cos^{-1}(x)) + \ldots + p'_4 + p'_5/2$$

$$Q'(x) = q'_o \cos(5 \cos^{-1}(x)) + q'_1(4 \cos^{-1}(x)) + \ldots + q'_4 x + q'_5/2$$

where $p'_o = 1$ $q'_o = 1$ $p'_i = p_i - p'_{i-1}\ 1 \leqq i \leqq 5$ $q'_i = q_i + q'_{i-1}\ 1 \leqq i \leqq 5$ The LSI coefficients are then calculated as:

$$lsi_i = \begin{cases} 0.5\sqrt{1 - lsc_i} & lsc_i \ge 0 \\ 1.0 - 0.5\sqrt{1 + lsc_i} & lsc_i < 0 \end{cases}$$

The LSCs can be obtained back from the LSI coefficients according to:

$$lsc_i = \begin{cases} 1.0 - 4lsi_i^2 & lsi_i \le 0.5 \\ (4 - 4lsi_i^2) - 1.0 & lsi_i > 0.5 \end{cases}$$

The stability of the LPC filter guarantees that the roots of the two functions alternate, i. e., the smallest root, $lsc_1$, is the smallest root of P'(x), the next smallest root, $lsc_2$, is the smallest root of Q'(x), etc. Thus, $lsc_1$, $lsc_3$, $lsc_5$, $lsc_7$, and $lsc_9$ are the roots of P'(x), and $ls_2$, $lsc_4$, $lsc_6$, $lsc_8$, and $lsc_{10}$ are the roots of Q'(x).

Those skilled in the art will recognize that it is preferable to employ some method for computing the sensitivity of the LSI coefficients to quantization. "Sensitivity weightings" can be used in the quantization process to appropriately weight the quantization error in each LSI.

The LSI coefficients are quantized using a multistage vector quantizer (VQ). The number of stages preferably depends on the particular bit rate and codebooks employed. The codebooks are chosen based on whether or not the current frame is voiced.

The vector quantization minimizes a weighted-mean-squared error (WMSE) which is defined as $$E(\vec{x}, \vec{y}) = \sum_{i=0}^{P-1} w_i(x_i - y_i)^2$$

where $\vec{x}$ is the vector to be quantized, $\vec{w}$ the weight associated with it, and $\vec{y}$ is the codevector. In a preferred embodiment, $\vec{w}$ are sensitivity weightings and P=10.

The LSI vector is reconstructed from the LSI codes obtained by way of quantization $$\vec{qlsi} = \sum_{i=1}^{N} CB\vec{i}_{code_i}$$

where CBi is the $i^{th}$ stage VQ codebook for either voiced or unvoiced frames (this is based on the code indicating the choice of the codebook) and $code_i$ is the LSI code for the $i^{th}$ stage.

Before the LSI coefficients are transformed to LPC coefficients, a stability check is performed to ensure that the resulting LPC filters have not been made unstable due to quantization noise or channel errors injecting noise into the LSI coefficients. Stability is guaranteed if the LSI coefficients remain ordered.

In calculating the original LPC coefficients, a speech window centered between the $119^{th}$ and $120^{th}$ sample of the frame was used. The LPC coefficients for other points in the frame are approximated by interpolating between the previous frame's LSCs and the current frame's LSCs. The resulting interpolated LSCs are then converted back into LPC coefficients. The exact interpolation used for each subframe is given by:

$$ilsc_j = (1-\alpha_i)lscprev_j + \alpha_i lsccurr_j,\ 1 \leqq j \leqq 10$$

where $\alpha_i$ are the interpolation factors 0.375, 0.625, 0.875, 1.000 for the four subframes of 40 samples each and ilsc are the interpolated LSCs. $\hat{P}_A(z)$ and $\hat{Q}_A(z)$ are computed by the interpolated LSCs as $$\hat{P}_A(z) = (1+z^{-1})\prod_{j=1}^{5} 1 - 2ilsc_{2j-1}z^{-1} + z^{-2}$$

$$\hat{Q}_A(z) = (1+z^{-1})\prod_{j=1}^{5} 1 - 2ilsc_{2j}z^{-1} + z^{-2}$$

The interpolated LPC coefficients for all four subframes are computed as coefficients of $$\hat{A}(z) = \frac{\hat{P}_A(z) + \hat{Q}_A(z)}{2}$$

$$\text{Thus, } \hat{a}_i = \begin{cases} -\dfrac{\hat{p}_i + \hat{q}_i}{2} & 1 \le i \le 5 \\ -\dfrac{\hat{p}_{11-i} - \hat{q}_{11-i}}{2} & 6 \le i \le 10 \end{cases}$$

C. NACF Calculation

In step 506, the normalized autocorrelation functions (NACFs) are calculated according to the current invention.

The formant residual for the next frame is computed over four 40 sample subframes as $$r(n) = s(n) - \sum_{i=1}^{10} \tilde{a}_i s(n-i)$$

where $\tilde{a}_i$ is the $i^{th}$ interpolated LPC coefficient of the corresponding subframe, where the interpolation is done between the current frame's unquantized LSCs and the next frame's LSCs. The next frame's energy is also computed as $$E_N = 0.5\log_2\left(\frac{\sum_{i=0}^{159} r^2(n)}{160}\right)$$

The residual calculated above is low pass filtered and decimated, preferably using a zero phase FIR filter of length 15, the coefficients of which $df_i$, $-7 \leqq i \leqq 7$, are {0.0800, 0.1256, 0.2532, 0.4376, 0.6424, 0.8268, 0.9544, 1.000, 0.9544, 0.8268, 0.6424, 0.4376, 0.2532, 0.1256, 0.0800}. The low pass filtered, decimated residual is computed as $$r_d(n) = \sum_{i=-7}^{7} df_i r(Fn+i), \quad 0 \le n < 160/F$$

where F=2 is the decimation factor, and r(Fn+i), $-7 \leqq Fn+i \leqq 6$ are obtained from the last 14 values of the current frame's residual based on unquantized LPC coefficients. As mentioned above, these LPC coefficients are computed and stored during the previous frame.

The NACFs for two subframes (40 samples decimated) of the next frame are calculated as follows:

$$Exx_k = \sum_{i=0}^{39} r_d(40k+i)r_d(40k+i), \qquad k = 0, 1$$

$$Exy_{k,j} = \sum_{i=0}^{39} r_d(40k+i)r_d(40k+i-j), \qquad 12/2 \le j < 128/2,\ k = 0, 1$$

$$Eyy_{k,j} = \sum_{i=0}^{39} r_d(40k+i-j)r_d(40k+i-j), \qquad 12/2 \le j < 128/2,\ k = 0, 1$$

$$n_corr_{k,j-12/2} = \frac{(Exy_{k,j})^2}{ExxEyy_{k,j}}, \qquad 12/2 \le j < 128/2,\ k = 0, 1$$

For $r_d(n)$ with negative n, the current frame's low-pass filtered and decimated residual (stored during the previous frame) is used. The NACFs for the current subframe c_corr were also computed and stored during the previous frame.

D. Pitch Track and Lag Calculation

In step 508, the pitch track and pitch lag are computed according to the present invention. The pitch lag is preferably calculated using a Viterbi-like search with a backward track as follows.

$$R1_i = \text{n_corr}_{0,i} + \max\{\text{n_corr}_{1,j+FAN_{i,0}}\}, \quad 0 \le i < 116/2, \quad 0 \le j < FAN_{i,1}$$

$$R2_i = \text{c_corr}_{l,i} + \max\{R1_{j+FAN_{i,o}}\}, \quad 0 \le i < 116/2, \quad 0 \le j < FAN_{i,1}$$

$$RM_{2i} = R2_i + \max\{\text{c_corr}_{0,j+FAN_{i,0}}\}, \quad 0 \le i < 116/2, \quad 0 \le j < FAN_{i,1}$$

where $FAN_{ij}$ is the 2×58 matrix, {{0, 2}, {0, 3}, {2, 2}, {2, 3}, {2, 4}, {3, 4}, {4, 4}, {5, 4}, {5, 5}, {6, 5}, {7, 5}, {8, 6}, {9, 6}, {10, 6}, {11, 6}, {11, 7}, {12, 7}, {13, 7 }, {14, 8}, {15, 8}, {16, 8}, {16, 9}, {17, 9}, {18, 9}, {19, 9}, {20, 10}, {21, 10}, {22, 10}, {22, 11}, {23, 11}, {24, 11}, {25, 12}, {26, 12}, {27, 12}, {28, 12}, {28, 13}, {29, 13}, {30, 13}, {31, 14}, {32, 14}, {33, 14}, {33, 15}, {34, 15}, {35, 15}, {36, 15}, {37, 16}, {38, 16}, {39, 16}, {39, 17}, {40, 17}, {41, 16}, {42, 16}, {43, 15}, {44, 14}, {45, 13}, {45, 13}, {46, 12}, {47, 11}}. The vector $RM_{2i}$ is interpolated to get values for $R_{2i+1}$ as $$RM_{iF+1} = \sum_{j=0}^{4} cf_j RM_{(i-1+j)F}, \quad 1 \le i < 112/2$$

$$RM_1 = (RM_0 + RM_2)/2$$

$$RM_{2*56+1} = (RM_{2*56} + RM_{2*57})/2$$

$$RM_{2*57+1} = RM_{2*57}$$

where $cf_j$ is the interpolation filter whose coefficients are {−0.0625, 0.5625, 0.5625, −0.0625}. The lag $L_C$ is then chosen such that $R_{L_{C-12}}=\max\{R_i\}$, $4 \leqq i \leqq 116$ and the current frame's NACF is set equal to $R_{L_{C-12}}/4$. Lag multiples are then removed by searching for the lag corresponding to the maximum correlation greater than 0.9 $R_{L_{C-12}}$ amidst:

$$R_{max\{\lfloor L_C/M \rfloor - 14,\ 16\}} \ldots R_{\lfloor L_C/M \rfloor - 10} \text{ for all } 1 \leqq M \leqq \lfloor L_C/16 \rfloor.$$

E. Calculation of Band Energy and Zero Crossing Rate

In step 510, energies in the 0–2 kHz band and 2 kHz-4 kHz band are computed according to the present invention as $$E_L = \sum_{i=0}^{159} s_L^2(n)$$

$$E_H = \sum_{i=0}^{159} s_H^2(n)$$

where, $$S_L(z) = S(z)\frac{bl_0 + \sum_{i=1}^{15} bl_i z^{-i}}{al_0 + \sum_{i=1}^{15} al_i z^{-i}}$$

$$S_H(z) = S(z)bh_0 + \frac{\sum_{i=1}^{15} bh_i z^{-i}}{ah_0 + \sum_{i=1}^{15} ah_i z^{-i}}$$

S(z), $S_L(z)$ and $S_H(z)$ being the z-transforms of the input speech signal s(n), low-pass signal $s_L(n)$ and high-pass signal $s_H(n)$, respectively, bl={0.0003, 0.0048, 0.0333, 0.1443, 0.4329, 0.9524, 1.5873, 2.0409, 2.0409, 1.5873, 0.9524, 0.4329, 0.1443, 0.0333, 0.0048, 0.0003}, al={1.0, 0.9155, 2.4074, 1.6511, 2.0597, 1.0584, 0.7976, 0.3020, 0.1465, 0.0394, 0.0122, 0.0021, 0.0004, 0.0, 0.0, 0.0}, bh={0.0013, −0.0189, 0.1324, −0.5737, 1.7212, −3.7867, 6.3112, −8.1144, 8.1144, −6.3112, 3.7867, −1.7212, 0.5737, −0.1324, 0.0189, −0.0013}and ah={1.0, −2.8818, 5.7550, −7.7730, 8.2419, −6.8372, 4.6171, −2.5257, 1.1296, −0.4084, 0.1183, −0.0268, 0.0046, −0.0006, 0.0, 0.0}.

The speech signal energy itself is $$E = \sum_{i=0}^{159} s^2(n).$$

The zero crossing rate ZCR is computed as $$if(s(n)s(n+1)<0)ZCR=ZCR+1,\ 0 \leqq n < 159$$

F. Calculation of the Formant Residual

In step 512, the formant residual for the current frame is computed over four subframes as $$r_{curr}(n) = s(n) - \sum_{i=1}^{10} \hat{a}_i s(n-i)$$

where $\hat{a}_i$ is the $i^{th}$ LPC coefficient of the corresponding subframe.

IV. Active/Inactive Speech Classification

Figure 6:
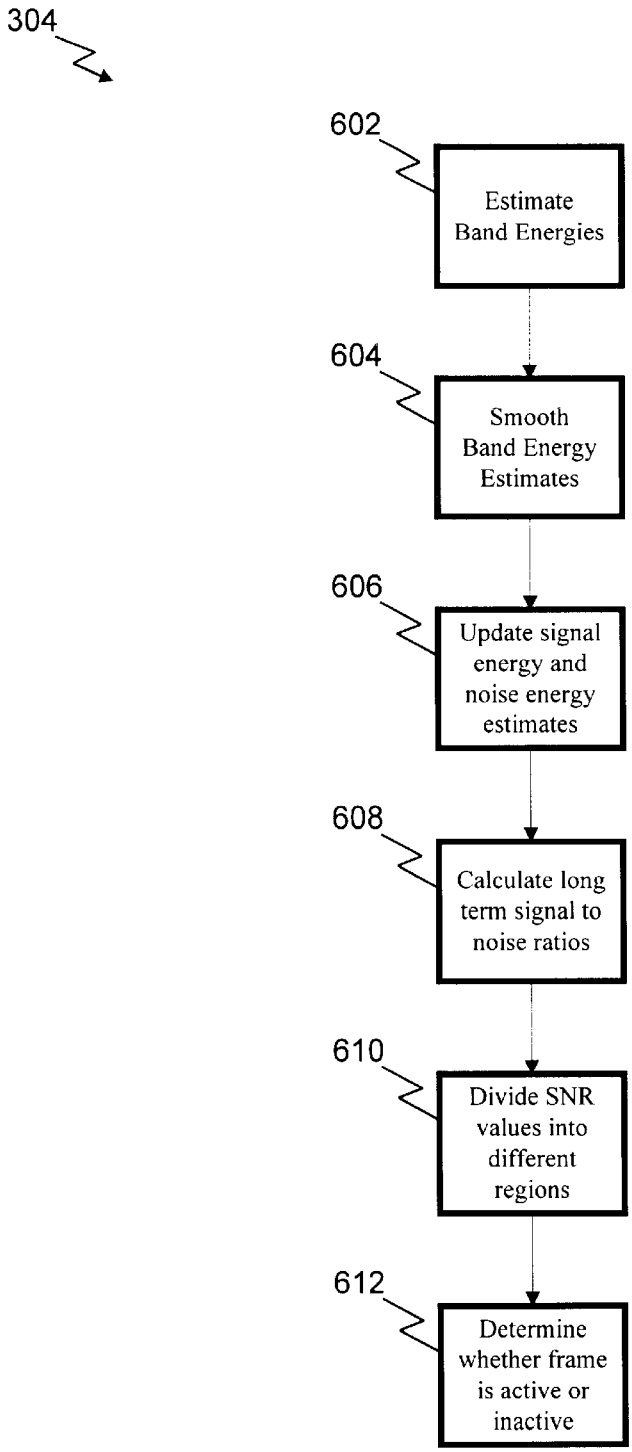
FIG. 6 is a flowchart describing the classification of speech as either active or inactive.

Referring back to FIG. 3, in step 304, the current frame is classified as either active speech (e.g., spoken words) or inactive speech (e.g., background noise, silence). FIG. 6 is a flowchart 600 that depicts step 304 in greater detail. In a preferred embodiment, a two energy band based thresholding scheme is used to determine if active speech is present. The lower band (band 0) spans frequencies from 0.1–2.0 kHz and the upper band (band 1) from 2.0–4.0 kHz. Voice activity detection is preferably determined for the next frame during the encoding procedure for the current frame, in the following manner.

In step 602, the band energies Eb[i] for bands i=0, 1 are computed. The autocorrelation sequence, as described above in Section III.A., is extended to 19 using the following recursive equation:

$$R(k) = \sum_{i=1}^{10} a_i R(k-i), \quad 11 \le k \le 19$$

Using this equation, R(11) is computed from R(1) to R(10), R(12) is computed from R(2) to R(11), and so on. The band energies are then computed from the extended autocorrelation sequence using the following equation:

$$E_b(i) = \log_2\left(R(0)R_h(0)(0) + 2\sum_{k=1}^{19} R(k)R_h(i)(k)\right), \quad i = 0, 1$$

where R(k) is the extended autocorrelation sequence for the current frame and $R_h(i)(k)$ is the band filter autocorrelation sequence for band i given in Table 1.

TABLE 1

Filter Autocorrelation Sequences for Band Energy Calculations

| k | $R_h(0)(k)$ band 0 | $R_h(1(k)$ band 1 |
|---|---|---|
| 0 | 4.230889E-01 | 4.042770E-O1 |
| 1 | 2.693014E-01 | −2.503076E-01 |
| 2 | −1.124000E-02 | −3.059308E-02 |
| 3 | −1.301279E-01 | 1.497124E-01 |
| 4 | −5.949044E-02 | −7.905954E-02 |
| 5 | 1.494007E-02 | 4.371288E-03 |
| 6 | −2.087666E-03 | −2.088545E-02 |
| 7 | −3.823536E-02 | 5.622753E-02 |
| 8 | −2.748034E-02 | −4.420598E-02 |
| 9 | 3.015699E-04 | 1.443167E-02 |
| 10 | 3.722060E-03 | −8.462525E-03 |
| 11 | −6.416949E-03 | 1.627144E-02 |
| 12 | −6.551736E-03 | −1.476080E-02 |
| 13 | 5.493820E-04 | 6.187041E-03 |
| 14 | 2.934550E-03 | −1.898632E-03 |
| 15 | 8.041829E-04 | 2.053577E-03 |
| 16 | −2.857628E-04 | −1.860064E-03 |
| 17 | 2.585250E-04 | 7.729618E-04 |
| 18 | 4.816371E-04 | −2.297862E-04 |
| 19 | 1.692738E-04 | 2.107964E-04 |

In step 604, the band energy estimates are smoothed. The smoothed band energy estimates, $E_{sm}(i)$, are updated for each frame using the following equation.

$$E_{sm}(i)=0.6E_{sm}(i)+0.4E_b(i),\ i=0,\ 1$$

In step 606, signal energy and noise energy estimates are updated. The signal energy estimates, $E_s(i)$, are preferably updated using the following equation:

$$E_s(i)=\max(E_{sm}(i),\ E_s(i)),\ i=0,\ 1$$

The noise energy estimates, $E_n(i)$, are preferably updated using the following equation:

$$E_n(i)=\min(E_{sm}(i),E_n(i)),i=0,\ 1$$

In step 608, the long term signal-to-noise ratios for the two bands, SNR(i), are computed as $$SNR(i)=E_s(i)-E_n(i),\ i=0,\ 1$$

In step 610, these SNR values are preferably divided into eight regions $Reg_{SNR}(i)$ defined as $$Reg_{SNR}(i)=\begin{cases}0 & 0.6SNR(i)-4<0\\ round(0.6SNR(i)-4) & \le 0.6SNR(i)-4<7\\ 7 & 0.6SNR(i)\ge 7\end{cases}$$

In step 612, the voice activity decision is made in the following manner according to the current invention. If either $E_b(\mathbf{0})-E_n(\mathbf{0})>\mathrm{THRESH}(Reg_{SNR}(\mathbf{0}))$, or $E_b(\mathbf{1})-E_n(\mathbf{1})>\mathrm{THRESH}(Reg_{SNR}(\mathbf{1}))$, then the frame of speech is declared active. Otherwise, the frame of speech is declared inactive. The values of THRESH are defined in Table 2.

TABLE 2

Threshold Factors as A function of the SNR Region

| SNR Region | THRESH |
|---|---|
| 0 | 2.807 |
| 1 | 2.807 |

TABLE 2-continued

Threshold Factors as A function of the SNR Region

| SNR Region | THRESH |
|---|---|
| 2 | 3.000 |
| 3 | 3.104 |
| 4 | 3.154 |
| 5 | 3.233 |
| 6 | 3.459 |
| 7 | 3.982 |

The signal energy estimates, $E_s(i)$, are preferably updated using the following equation:

$$E_s(i)=E_s(i)-0.014499,\ i=0,\ 1.$$

The noise energy estimates, $E_n(i)$, are preferably updated using the following equation:

$$E_n(i)=\begin{cases}4 & E_n(i)+0.0066<4\\ 23 & 23<E_n(i)+0.0066,\quad i=0,\ 1\\ E_n(i)+0.0066 & \text{otherwise}\end{cases}$$

A. Hangover Frames

When signal-to-noise ratios are low, "hangover" frames are preferably added to improve the quality of the reconstructed speech. If the three previous frames were classified as active, and current frame is classified inactive, then the next M frames including the current frame are classified as active speech. The number of hangover frames, M, is preferably determined as a function of SNR(0) as defined in Table 3.

TABLE 3

Hangover Frames as a Function of SNR(0)

| SNR(0) | M |
|---|---|
| 0 | 4 |
| 1 | 3 |
| 2 | 3 |
| 3 | 3 |
| 4 | 3 |
| 5 | 3 |
| 6 | 3 |
| 7 | 3 |

V. Classification of Active Speech Frames

Referring back to FIG. 3, in step 308, current frames which were classified as being active in step 304 are further classified according to properties exhibited by the speech signal s(n). In a preferred embodiment, active speech is classified as either voiced, unvoiced, or transient. The degreed of periodicity exhibited by the active speech signal determines how it is classified. Voiced speech exhibits the highest degree of periodicity (quasi-periodic in nature). Unvoiced speech exhibits little or no periodicity. Transient speech exhibits degrees of periodicity between voiced and unvoiced.

However, the general framework described herein is not limited to the preferred classification scheme and the specific encoder/decoder modes described below. Active speech can be classified in alternative ways, and alternative encoder/decoder modes are available for coding. Those skilled in the art will recognize that many combinations of classifications and encoder/decoder modes are possible. Many such combinations can result in a reduced average bit rate according to the general framework described herein, i.e., classifying speech as inactive or active, further classifying active speech, and then coding the speech signal using encoder/decoder modes particularly suited to the speech falling within each classification.

Although the active speech classifications are based on degree of periodicity, the classification decision is preferably not based on some direct measurement of periodicity. Rather, the classification decision is based on various parameters calculated in step 302, e.g., signal to noise ratios in the upper and lower bands and the NACFs. The preferred classification may be described by the following pseudocode:

```
if not(previousN ACF<0.5 and currentN ACF>0.6)
  if (currentN ACF<0.75 and ZCR>60) UNVOICED
  else if (previousN ACF<0.5 and currentN ACF<0.55
    and ZCR>50) UNVOICED
  else if (currentN ACF<0.4 and ZCR>40) UNVOICED
if (UNVOICED and currentSNR>28 dB and E_L>αE_H)
  TRANSIENT
if (previousN ACF<0.5 and currentN ACF<0.5 and E
  <5e4+N) UNVOICED
if (VOICED and low-bandSNR>high-bandSNR and pre-
  viousN ACF<0.8 and 0.6<currentN ACF<0.75) TRAN-
  SIENT
```

where $$\alpha = \begin{cases} 1.0, & E > 5e5 + N_{noise} \\ 20.0, & E \le 5e5 + N_{noise} \end{cases}$$

and $N_{noise}$ is an estimate of the background noise. $E_{prev}$ is the previous frame's input energy.

The method described by this pseudo code can be refined according to the specific environment in which it is implemented. Those skilled in the art will recognize that the various thresholds given above are merely exemplary, and could require adjustment in practice depending upon the implementation. The method may also be refined by adding additional classification categories, such as dividing TRANSIENT into two categories: one for signals transitioning from high to low energy, and the other for signals transitioning from low to high energy.

Those skilled in the art will recognize that other methods are available for distinguishing voiced, unvoiced, and transient active speech. Similarly, skilled artisans will recognize that other classification schemes for active speech are also possible.

VI. Encoder/Decoder Mode Selection

In step 310, an encoder/decoder mode is selected based on the classification of the current frame in steps 304 and 308. According to a preferred embodiment, modes are selected as follows: inactive frames and active unvoiced frames are coded using a NELP mode, active voiced frames are coded using a PPP mode, and active transient frames are coded using a CELP mode. Each of these encoder/decoder modes is described in detail in following sections.

In an alternative embodiment, inactive frames are coded using a zero rate mode Skilled artisans will recognize that many alternative zero rate modes are available which require very low bit rates. The selection of a zero rate mode may be further refined by considering past mode selections. For example, if the previous frame was classified as active, this may preclude the selection of a zero rate mode for the current frame. Similarly, if the next frame is active, a zero rate mode may be precluded for the current frame. Another alternative is to preclude the selection of a zero rate mode for too many consecutive frames (e.g., 9 consecutive frames). Those skilled in the art will recognize that many other modifications might be made to the basic mode selection decision in order to refine its operation in certain environments.

As described above, many other combinations of classifications and encoder/decoder modes might be alternatively used within this same framework. The following sections provide detailed descriptions of several encoder/decoder modes according to the present invention. The CELP mode is described first, followed by the PPP mode and the NELP mode.

VII. Code Excited Linear Prediction (CELP) Coding Mode

As described above, the CELP encoder/decoder mode is employed when the current frame is classified as active transient speech. The CELP mode provides the most accurate signal reproduction (as compared to the other modes described herein) but at the highest bit rate.

Figure 7A:
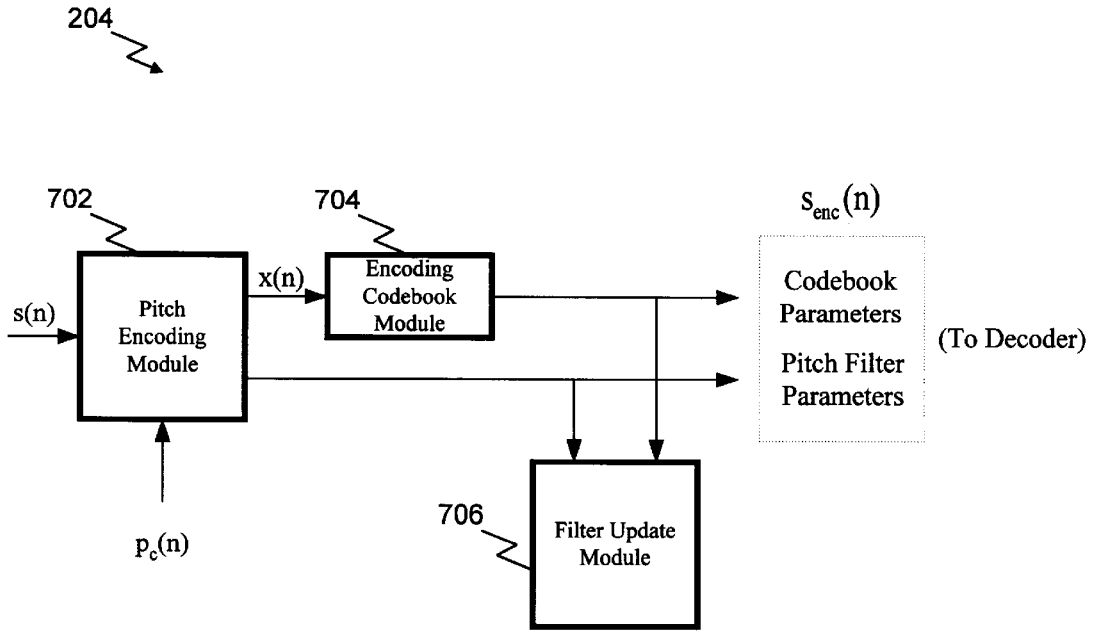
FIG. 7A depicts a CELP encoder.
Figure 7B:
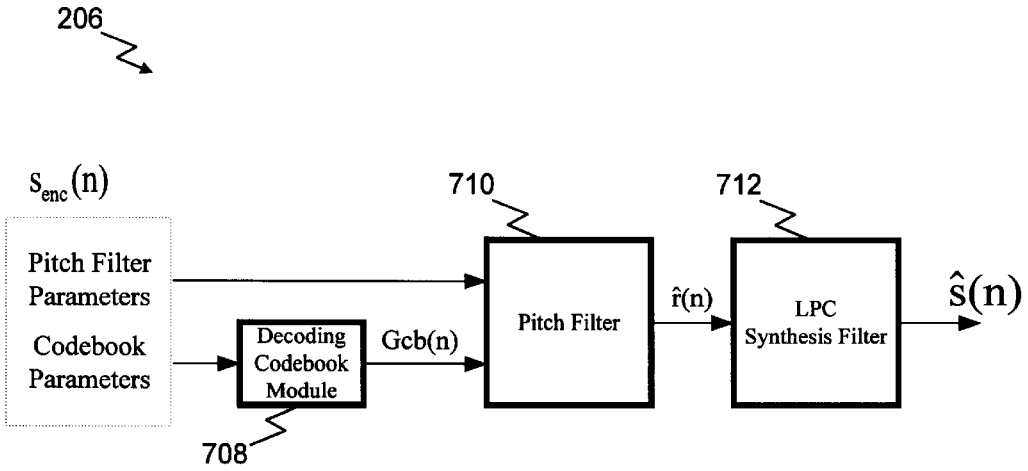
FIG. 7B depicts a CELP decoder.

FIG. 7 depicts a CELP encoder mode 204 and a CELP decoder mode 206 in farther detail. As shown in FIG. 7A, CELP encoder mode 204 includes a pitch encoding module 702, an encoding codebook 704, and a filter update module 706. CELP encoder mode 204 outputs an encoded speech signal, $s_{enc}(n)$, which preferably includes codebook parameters and pitch filter parameters, for transmission to CELP decoder mode 206. As shown in FIG. 7B, CELP decoder mode 206 includes a decoding codebook module 708, a pitch filter 710, and an LPC synthesis filter 712. CELP decoder mode 206 receives the encoded speech signal and outputs synthesized speech signal $\hat{s}(n)$.

A. Pitch Encoding Module

Pitch encoding module 702 receives the speech signal s(n) and the quantized residual from the previous frame, $p_c(n)$ (described below). Based on this input, pitch encoding module 702 generates a target signal x(n) and a set of pitch filter parameters. In a preferred embodiment, these pitch filter parameters include an optimal pitch lag L* and an optimal pitch gain b*. These parameters are selected according to an "analysis-by-synthesis" method in which the encoding process selects the pitch filter parameters that minimize the weighted error between the input speech and the synthesized speech using those parameters.

Figure 8:
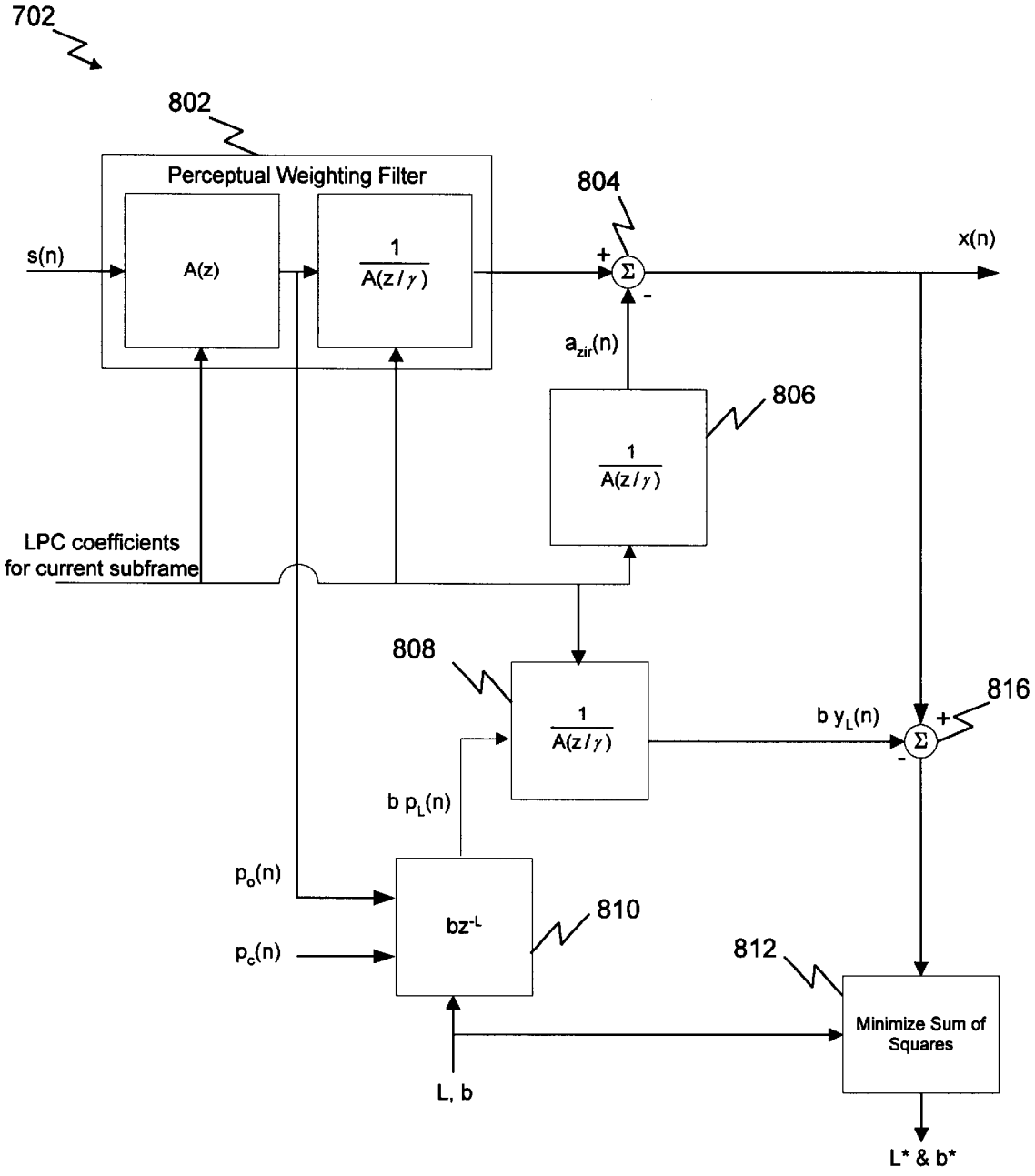
FIG. 8 depicts a pitch filter module.

FIG. 8 depicts pitch encoding module 702 in greater detail. Pitch encoding module 702 includes a perceptual weighting filter 802, adders 804 and 816, weighted LPC synthesis filters 806 and 808, a delay and gain 810, and a minimize sum of squares 812.

Perceptual weighting filter 802 is used to weight the error between the original speech and the synthesized speech in a perceptually meaningful way. The perceptual weighting filter is of the form $$W(z) = \frac{A(z)}{A(z/\gamma)}$$

where A(z) is the LPC prediction error filter, and y preferably equals 0.8. Weighted LPC analysis filter 806 receives the LPC coefficients calculated by initial parameter calculation module 202. Filter 806 outputs $a_{zir}(n)$, which is the zero input response given the LPC coefficients. Adder 804 sums a negative input $a_{zir}(n)$ and the filtered input signal to form target signal x(n).

Delay and gain 810 outputs an estimated pitch filter output $bp_L(n)$ for a given pitch lag L and pitch gain b. Delay and gain 810 receives the quantized residual samples from the previous frame, $p_c(n)$, and an estimate of future output of the pitch filter, given by $p_o(n)$, and forms p(n) according to:

$$p(n) = \begin{cases} p_c(n) & -128 < n < 0 \\ p_o(n) & 0 \le n < L_p \end{cases}$$

which is then delayed by L samples and scaled by b to form $bp_L(n)$. Lp is the subframe length (preferably 40 samples). In a preferred embodiment, the pitch lag, L, is represented by 8 bits and can take on values 20.0, 20.5, 21.0, 21.5, . . . 126.0, 126.5, 127.0, 127.5.

Weighted LPC analysis filter 808 filters $bp_L(n)$ using the current LPC coefficients resulting in $by_L(n)$. Adder 816 sums a negative input $by_L(n)$ with x(n), the output of which is received by minimize sum of squares 812. Minimize sum of squares 812 selects the optimal L, denoted by L* and the optimal b, denoted by b*, as those values of L and b that minimize $E_{pitch}(L)$ according to:

$$E_{pitch}(L) = \sum_{n=0}^{L_p-1} \{x(n) - by_L(n)\}^2$$

$$\text{If} \quad E_{xy}(L) \triangleq \sum_{n=0}^{L_p-1} x(n)y_L(n) \quad \text{and} \quad E_{yy}(L) \triangleq \sum_{n=0}^{L_p-1} y_L(n)^2,$$

then the value of b which minimizes $E_{pitch}(L)$ for a given value of L is $$b^* = \frac{E_{xy}(L)}{E_{yy}(L)}$$

for which $$E_{pitch}(L) = K - \frac{E_{xy}(L)^2}{E_{yy}(L)}$$

where K is a constant that can be neglected.

The optimal values of L and b (L* and b*) are found by first determining the value of L which minimizes $E_{pitch}(L)$ and then computing b*.

These pitch filter parameters are preferably calculated for each subframe and then quantized for efficient transmission. In a preferred embodiment, the transmission codes PLAGj and PGAINj for the $j^{th}$ subframe are computed as $$PGAINj = \left\lfloor \min\{b^*, 2\}\frac{8}{2} + 0.5 \right\rfloor - 1$$

$$PLAG_j = \begin{cases} 0, & PGAINj = -1 \\ 2L^*, & 0 \le PGAINj < 8 \end{cases}$$

$PGAIN_J$ is then adjusted to −1 if $PLAG_J$ is set to 0. These transmission codes are transmitted to CELP decoder mode 206 as the pitch filter parameters, part of the encoded speech signal $s_{enc}(n)$.

B. Encoding Codebook

Encoding codebook 704 receives the target signal x(n) and determines a set of codebook excitation parameters which are used by CELP decoder mode 206, along with the pitch filter parameters, to reconstruct the quantized residual signal.

Encoding codebook 704 first updates x(n) as follows.

$$x(n) = x(n) - y_{pzir}(n), \; 0 \le n < 40$$

where $y_{pzir}(n)$ is the output of the weighted LPC synthesis filter (with memories retained from the end of the previous subframe) to an input which is the zero-input-response of the pitch filter with parameters $\hat{L}^*$ and $\hat{b}^*$(and memories resulting from the previous subframe's processing).

A backfiltered target $\vec{d} \approx \{d_n\}$, $0 \le n < 40$ is created as $\vec{d} \approx H^T \vec{x}$ where $$H = \begin{bmatrix} h_0 & 0 & 0 & \dots & 0 \\ h_1 & h_0 & 0 & \dots & 0 \\ \dots & \dots & \dots & \dots & \dots \\ h_{39} & h_{38} & h_{37} & \dots & h_0 \end{bmatrix}$$

is the impulse response matrix formed from the impulse response $\{h_n\}$ and $\hat{x} \approx \{x(n)\}, 0 \le n < 40$. Two more vectors $\hat{\phi} = \{\phi_n\}$ and $\vec{s}$ are created as well.

$$\vec{s} \approx \text{sign}(\vec{d})$$

$$\phi_n = \begin{cases} 2\sum_{i=0}^{39-n} h_i h_{i+n}, & 0 < n < 40 \\ \sum_{i=0}^{39} h_i^2, & n = 0 \end{cases}$$

where $$sign(x) = \begin{cases} 1, & x \ge 0 \\ -1, & x < 0 \end{cases}$$

Encoding codebook 704 initializes the values Exy* and Eyy* to zero and searches for the optimum excitation parameters, preferably with four values of N (0, 1, 2, 3), according to:

$$\vec{p} = (N + \{0, 1, 2, 3, 4\})\%5$$

$$A = \{p_0, p_0 + 5, \dots, i' < 40\}$$

$$B = \{p_1, p_1 + 5, \dots, k' < 40\}$$

$$Den_{i,k} = 2\phi_0 + s_i s_k \phi_{|k-i|}, \quad i \in A \quad k \in B$$

$$\{I_0, I_1\} = \underset{\substack{i \in A \\ i \in B}}{\text{argmax}}\left\{\frac{|d_i| + |d_k|}{Den_{i,k}}\right\}$$

$$\{S_0, S_1\} = \{s_{I_0}, s_{I_1}\}$$

$$Exy0 = |d_{I_0}| + |d_{I_1}|$$

$$Eyy0 = Eyy_{I_0, I_1}$$

$$A = \{p_2, p_2 + 5, \dots, i' < 40\}$$

$$B = \{p_3, p_3 + 5, \dots, k' < 40\}$$

$$Den_{i,k} = Eyy0 + 2\phi_0 + s_i(S_0\phi_{|I_0-i|} + S_1\phi_{|I_1-i|}) + s_k(S_0\phi_{|I_0-k|} + S_1\phi_{|I_1-k|}) + s_i s_k \phi_{|k-i|}$$

$$i \in Ak \in B$$

$$\{I_2, I_3\} = \underset{\substack{i \in A \\ k \in B}}{\text{argmax}}\left\{\frac{Exy0 + |d_i| + |d_k|}{Den_{i,k}}\right\}$$

$$\{S2, S_3\} = \{s_{I_2}, s_{I_3}\}$$

$$Exy1 = Exy0 + |d_{I_2}| + |d_{I_3}|$$

$$Eyy1 = Den_{I_2, I_3}$$

-continued $$A = \{p_4, p_4 + 5, \ldots, i' < 40\}$$

$$Den_i = Eyy1 + \phi_0 + s_i(S_0\phi_{|I_0-i|} + S_1\phi_{|I_1-i|} + S_2\phi_{|I_2-i|} + S_3\phi_{|I_3-i|}), \quad i \in A$$

$$I_4 = \underset{i \in A}{\operatorname{argmax}}\left\{\frac{Exy1 + |d_i|}{Den_i}\right\}$$

$$S_4 = s_{I_4}$$

$$Exy2 = Exy1 + |d_{I_4}|$$

$$Eyy2 = Den_{I_4}$$

$$\text{If } Exy2^2 Eyy^* > Exy^{*2} Eyy2\{ \quad Exy^* = Exy2 \quad Eyy^* = Eyy2 \quad \{ind_{p0}, ind_{p1}, ind_{p2}, ind_{p3}, ind_{p4}\} = \{I_0, I_1, I_2, I_3, I_4\} \quad \{sgn_{p0}, sgn_{p1}, sgn_{p2}, sgn_{p3}, sgn_{p4}\} = \{S_0, S_1, S_2, S_3, S_4\}\}$$

Encoding codebook 704 calculates the codebook gain $$G^* \text{ as } \frac{Exy^*}{Eyy^*},$$

and then quantizes the set of excitation parameters as the following transmission codes for the $j^{th}$ subframe:

$$CBIjk = \left\lfloor \frac{ind_k}{5} \right\rfloor, \quad 0 \le k < 5$$

$$SIGNjk = \begin{cases} 0, & sgn_k = 1 \\ 1, & sgn_k = -1 \end{cases}, \quad 0 \le k < 5$$

$$CBGj = \left\lfloor \min\{\log_2(\max\{1, G^*\}), 11.2636\}\frac{31}{11.2636} + 0.5 \right\rfloor$$

and the quantized gain $$\hat{G}^* \text{ is } 2^{CBGj\frac{11.2636}{31}}.$$

Lower bit rate embodiments of the CELP encoder/decoder mode may be realized by removing pitch encoding module 702 and only performing a codebook search to determine an index I and gain G for each of the four subframes. Those skilled in the art will recognize how the ideas described above might be extended to accomplish this lower bit rate embodiment.

C. CELP Decoder

CELP decoder mode 206 receives the encoded speech signal, preferably including codebook excitation parameters and pitch filter parameters, from CELP encoder mode 204, and based on this data outputs synthesized speech ŝ(n). Decoding codebook module 708 receives the codebook excitation parameters and generates the excitation signal cb(n) with a gain of G. The excitation signal cb(n) for the $j^{th}$ subframe contains mostly zeroes except for the five locations:

$$I_k = 5CBIjk + k, \quad 0 \le k < 5$$

which correspondingly have impulses of value $$S_k = 1 - 2SIGNjk, \quad 0 < k < 5$$

all of which are scaled by the gain G which is computed to be $$2^{CBGj\frac{11.2636}{31}},$$

to provide Gcb(n).

Pitch filter 710 decodes the pitch filter parameters from the received transmission codes according to:

$$\hat{L}^* = \frac{PLAGj}{2}$$

$$\hat{b}^* = \begin{cases} 0, & \hat{L}^* = 0 \\ \frac{2}{8}PGAINj, & \hat{L}^* \neq 0 \end{cases}$$

Pitch filter 710 then filters Gcb(n), where the filter has a transfer function given by $$\frac{1}{P(z)} = \frac{1}{1 - b * z^{-L^*}}$$

In a preferred embodiment, CELP decoder mode 206 also adds an extra pitch filtering operation, a pitch prefilter (not shown), after pitch filter 710. The lag for the pitch prefilter is the same as that of pitch filter 710, whereas its gain is preferably half of the pitch gain up to a maximum of 0.5.

LPC synthesis filter 712 receives the reconstructed quantized residual signal r̂(n) and outputs the synthesized speech signal ŝ(n).

D. Filter Update Module

Filter update module 706 synthesizes speech as described in the previous section in order to update filter memories. Filter update module 706 receives the codebook excitation parameters and the pitch filter parameters, generates an excitation signal cb(n), pitch filters Gcb(n), and then synthesizes ŝ(n). By performing this synthesis at the encoder, memories in the pitch filter and in the LPC synthesis filter are updated for use when processing the following subframe.

VIII. Prototype Pitch Period (PPP) Coding Mode

Prototype pitch period (PPP) coding exploits the periodicity of a speech signal to achieve lower bit rates than may be obtained using CELP coding. In general, PPP coding involves extracting a representative period of the residual signal, referred to herein as the prototype residual, and then using that prototype to construct earlier pitch periods in the frame by interpolating between the prototype residual of the current frame and a similar pitch period from the previous frame (i.e., the prototype residual if the last frame was PPP). The effectiveness (in terms of lowered bit rate) of PPP coding depends, in part, on how closely the current and previous prototype residuals resemble the intervening pitch periods. For this reason, PPP coding is preferably applied to speech signals that exhibit relatively high degrees of periodicity (e.g., voiced speech), referred to herein as quasi-periodic speech signals.

Figure 9A:
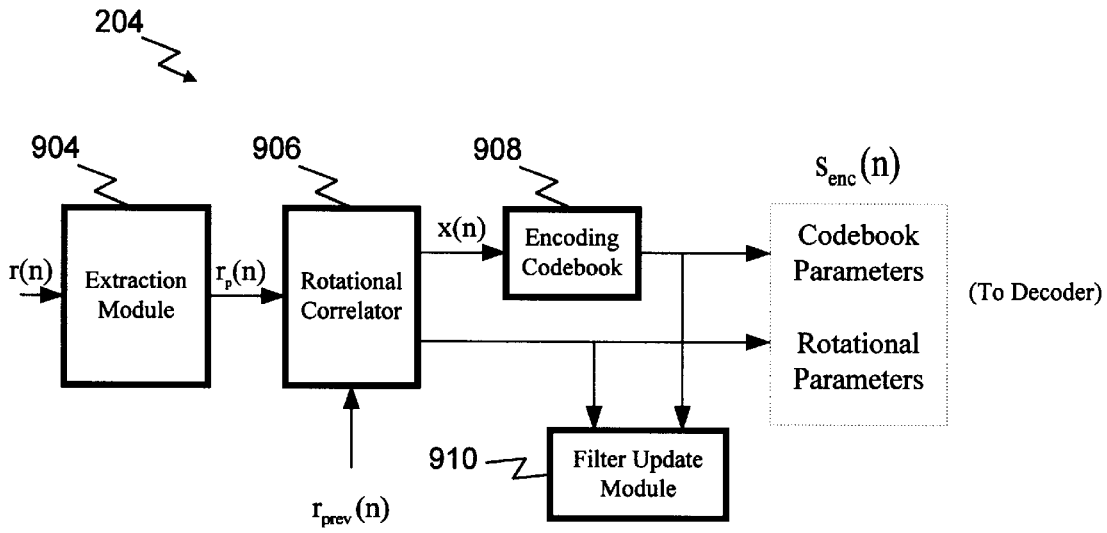
FIG. 9A depicts a PPP encoder.
Figure 9B:
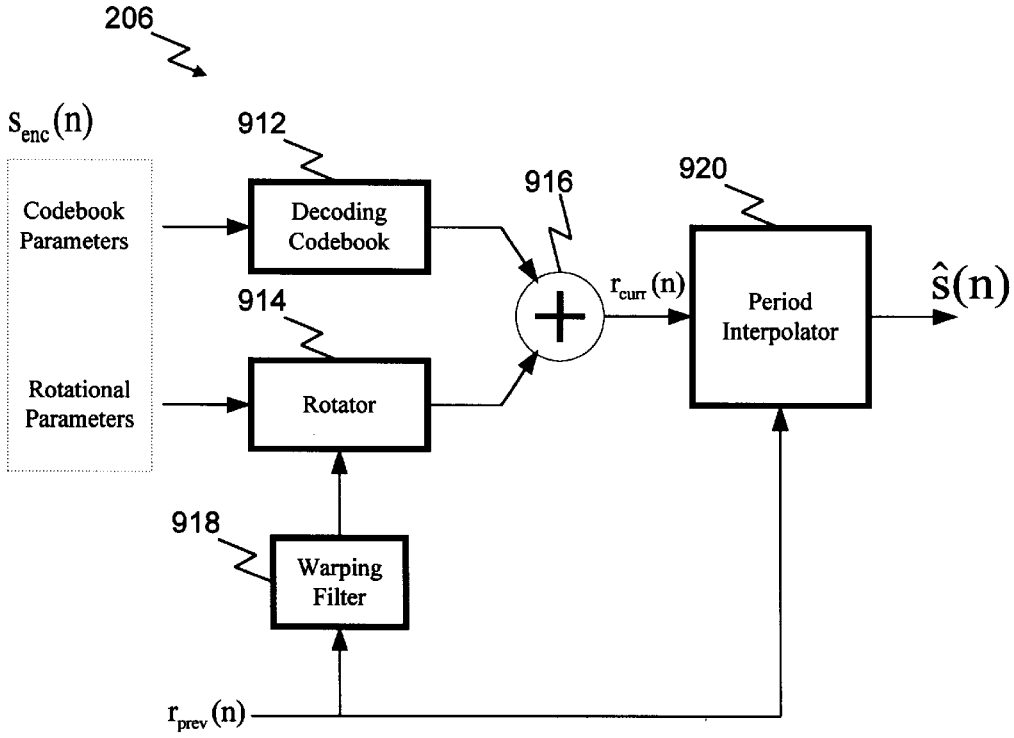
FIG. 9B depicts a PPP decoder.

FIG. 9 depicts a PPP encoder mode 204 and a PPP decoder mode 206 in further detail. PPP encoder mode 204 includes an extraction module 904, a rotational correlator 906, an encoding codebook 908, and a filter update module 910. PPP encoder mode 204 receives the residual signal r(n) and outputs an encoded speech signal $s_{enc}(n)$, which preferably includes codebook parameters and rotational parameters. PPP decodermode 206 includes a codebook decoder 912, a rotator 914, an adder 916, a period interpolator 920, and a warping filter 918.

Figure 10:
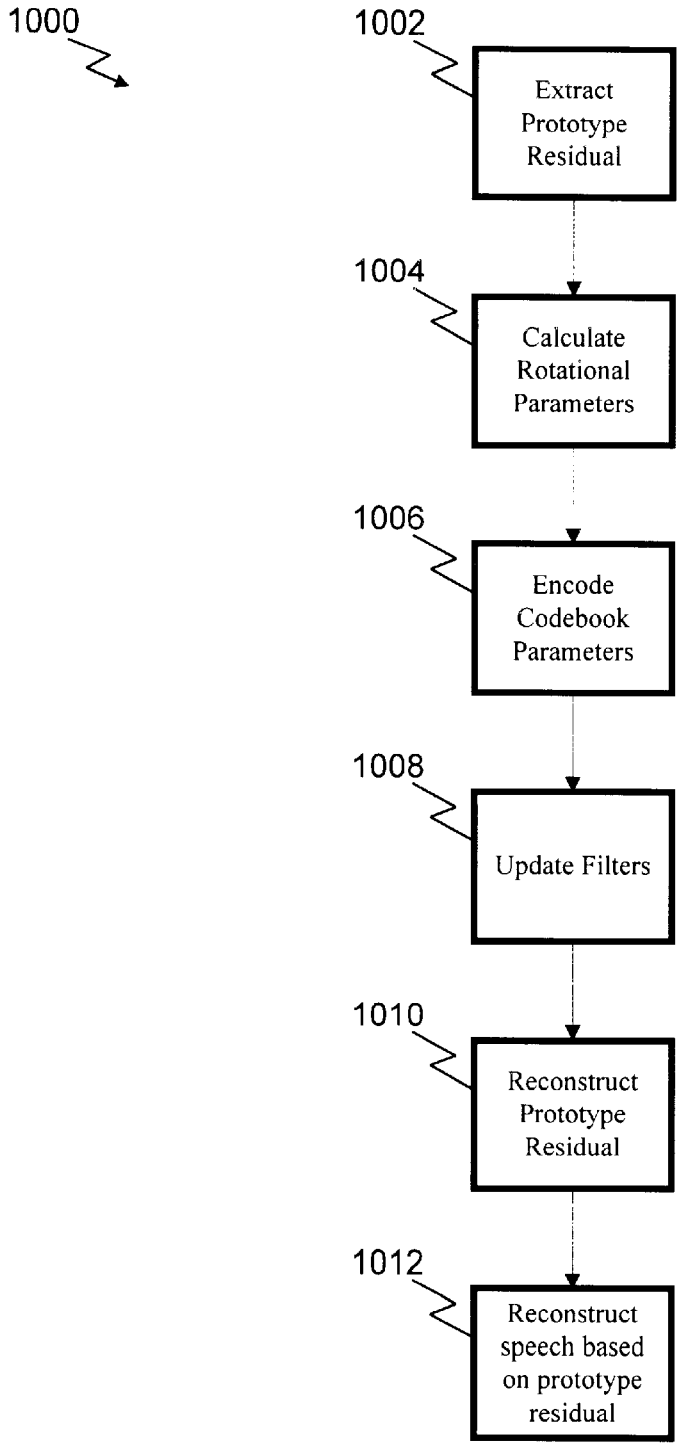
FIG. 10 is a flowchart depicting the steps of PPP coding, including encoding and decoding.

FIG. 10 is a flowchart 1000 depicting the steps of PPP coding, including encoding and decoding. These steps are discussed along with the various components of PPP encoder mode 204 and PPP decoder mode 206.

A. Extraction Module

In step 1002, extraction module 904 extracts a prototype residual $r_p(n)$ from the residual signal r(n). As described above in Section III.F., initial parameter calculation module 202 employs an LPC analysis filter to compute r(n) for each frame. In a preferred embodiment, the LPC coefficients in this filter are perceptually weighted as described in Section VII.A. The length of $r_p(n)$ is equal to the pitch lag L computed by initial parameter calculation module 202 during the last subframe in the current frame.

Figure 11:
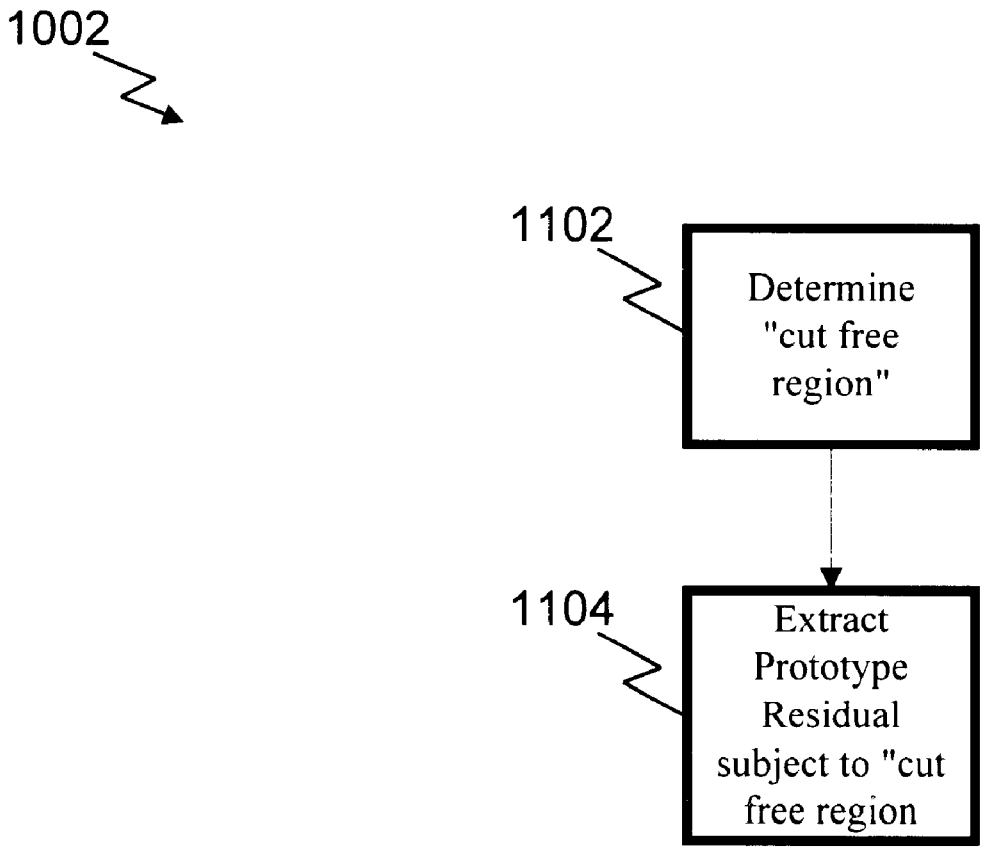
FIG. 11 is a flowchart describing the extraction of a prototype residual period.
Figure 12:
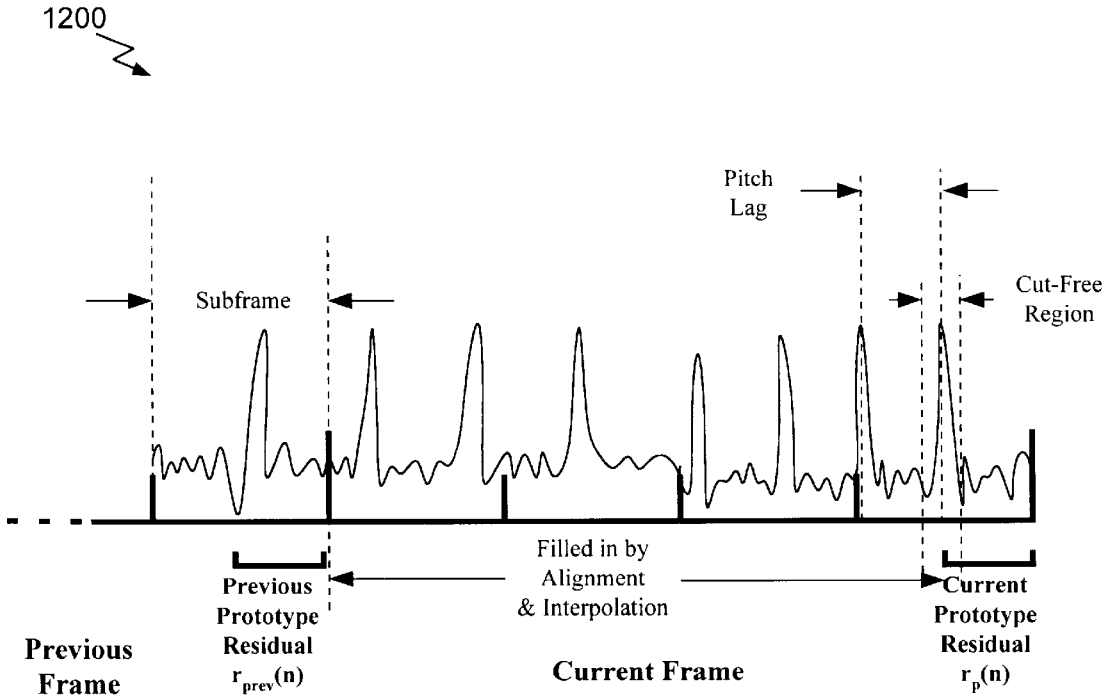
FIG. 12 depicts a prototype residual period extracted from the current frame of a residual signal, and the prototype residual period from the previous frame.

FIG. 11 is a flowchart depicting step 1002 in greater detail. PPP extraction module 904 preferably selects a pitch period as close to the end of the frame as possible, subject to certain restrictions discussed below. FIG. 12 depicts an example of a residual signal calculated based on quasi-periodic speech, including the current frame and the last subframe from the previous frame.

In step 1102, a "cut-free region" is determined. The cut-free region defines a set of samples in the residual which cannot be endpoints of the prototype residual. The cut-free region ensures that high energy regions of the residual do not occur at the beginning or end of the prototype (which could cause discontinuities in the output were it allowed to happen). The absolute value of each of the final L samples of r(n) is calculated. The variable $P_S$ is set equal to the time index of the sample with the largest absolute value, referred to herein as the "pitch spike." For example, if the pitch spike occurred in the last sample of the final L samples, $P_S$=L−1. In a preferred embodiment, the minimum sample of the cut-free region, $CF_{min}$, is set to be $P_S$−6 or $P_S$−0.25L, whichever is smaller. The maximum of the cut-free region, $CF_{max}$, is set to be $P_S$+6 or $P_S$+0.25L, whichever is larger.

In step 1104, the prototype residual is selected by cutting L samples from the residual. The region chosen is as close as possible to the end of the frame, under the constraint that the endpoints of the region cannot be within the cut-free region. The L samples of the prototype residual are determined using the algorithm described in the following pseudo-code:

```
if(CF_min<0) {
   for(i=0 to L+CF_min−1)r_p(i)=r(i+160−L)
for(i=CF_min to L−1)r_p(i)=r(i+160−2L)
}
else if(CF_max≦L {
   for(i=0 to CF_min−1)r_p(i)=r(i+160−L)
   for(i=CF_min to L−1)r_p(i)=r(i+160−2L)
}
else {
   for(i=0 to L−1)r_p(i)=r(i+160−L)
}
```

B. Rotational Correlator

Figure 13:
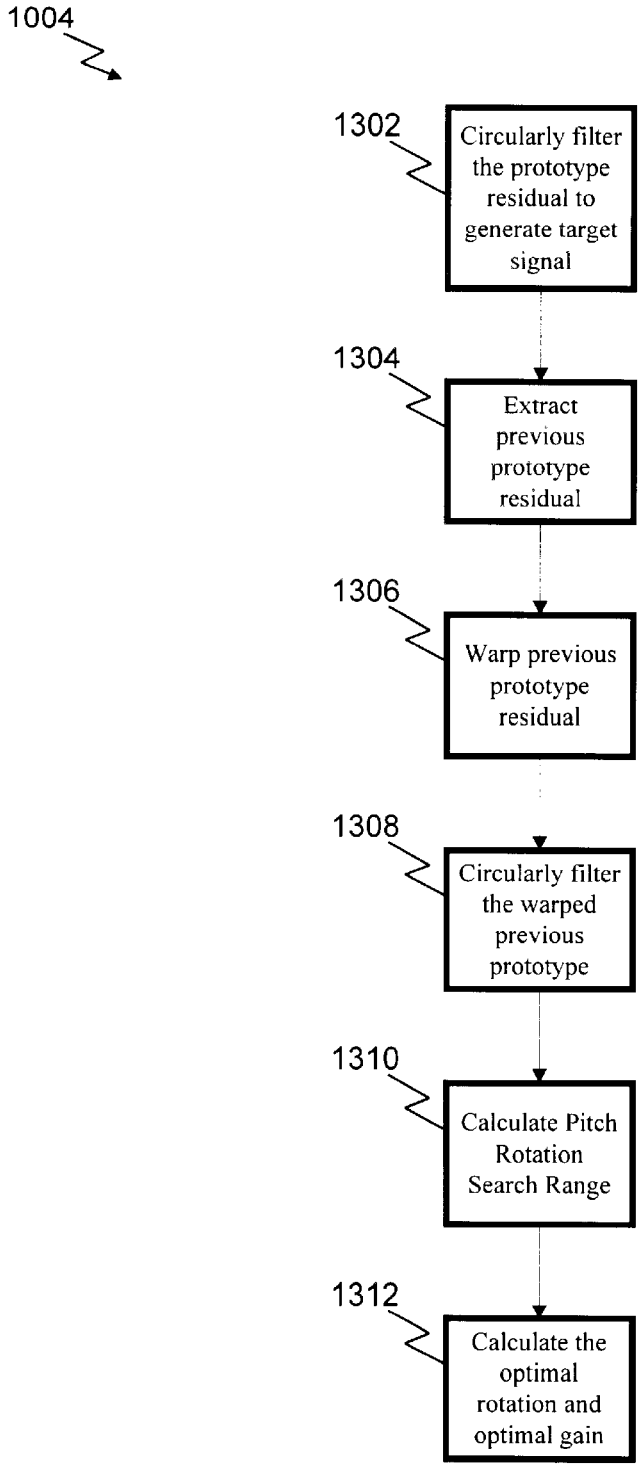
FIG. 13 is a flowchart depicting the calculation of rotational parameters.

Referring back to FIG. 10, in step 1004, rotational correlator 906 calculates a set of rotational parameters based on the current prototype residual, $r_p(n)$, and the prototype residual from the previous frame, $r_{prev}(n)$. These parameters describe how $r_{prev}(n)$ can best be rotated and scaled for use as a predictor of $r_p(n)$. In a preferred embodiment, the set of rotational parameters includes an optimal rotation R* and an optimal gain b*. FIG. 13 is a flowchart depicting step 1004 in greater detail.

In step 1302, the perceptually weighted target signal x(n), is computed by circularly filtering the prototype pitch residual period $r_p(n)$. This is achieved as follows. A temporary signal tmp1(n) is created from $r_p(n)$ as $$tmp1(n)=\begin{cases} r_p(n), & 0 \le n < L \\ 0, & L \le n < 2L \end{cases}$$

which is filtered by the weighted LPC synthesis filter with zero memories to provide an output tmp2(n). In a preferred embodiment, the LPC coefficients used are the perceptually weighted coefficients corresponding to the last subframe in the current frame. The target signal x(n) is then given by $$x(n)=tmp2(n)+tmp2(n+L),\ 0 \leqq n < L$$

In step 1304, the prototype residual from the previous frame, $r_{prev}(n)$, is extracted from the previous frame's quantized formant residual (which is also in the pitch filter's memories). The previous prototype residual is preferably defined as the last $L_p$ values of the previous frame's formant residual, where $L_p$ is equal to L if the previous frame was not a PPP frame, and is set to the previous pitch lag otherwise.

In step 1306, the length of $r_{prev}(n)$ is altered to be of the same length as x(n) so that correlations can be correctly computed. This technique for altering the length of a sampled signal is referred to herein as warping. The warped pitch excitation signal, $rw_{prev}(n)$, may be described as $$rw_{prev}(n)=r_{prev}(n*TWF),\ 0 \leqq n < L$$

where TWF is the time warping factor $$\frac{L_p}{L}$$

The sample values at non-integral points n * TWF are preferably computed using a set of sinc function tables. The sinc sequence chosen is sinc(−3−F: 4−F) where F is the fractional part of n * TWF rounded to the nearest multiple of $$\frac{1}{8}.$$

The beginning of this sequence is aligned with $r_{prev}((N-3)\%L_p)$ where N is the integral part of n*TWF after being rounded to the nearest eighth.

In step 1308, the warped pitch excitation signal $rw_{prev}(n)$ is circularly filtered, resulting in y(n). This operation is the same as that described above with respect to step 1302, but applied to $rw_{prev}(n)$.

In step 1310, the pitch rotation search range is computed by first calculating an expected rotation $E_{rot}$, $$E_{rot}=L-round\left(L\ frac\left(\frac{(160-L)(L_p+L)}{2L_pL}\right)\right)$$

where frac(x) gives the fractional part of x. If L<80, the pitch rotation search range is defined to be $\{E_{rot}-8, E_{rot}-7.5, \ldots E_{rot}+7.5\}$, and $\{E_{rot}-16, E_{rot}-15, \ldots E_{rot}+15\}$ where L≧80.

In step 1312, the rotational parameters, optimal rotation R* and an optimal gain b*, are calculated. The pitch rotation which results in the best prediction between x(n) and y(n) is chosen along with the corresponding gain b. These parameters are preferably chosen to minimize the error signal e(n)=x(n)−y(n). The optimal rotation R* and the optimal gain b* are those values of rotation R and gain b which result in the maximum value of $$\frac{Exy_R^2}{E_{yy}}, \text{ where } Exy_R = \sum_{i=0}^{L-1} x((i+R)\%L)y(i) \text{ and } Eyy = \sum_{i=0}^{L-1} y(i)y(i)$$

for which the optimal gain $$b^* \text{ is } \frac{Exy_{R^*}}{Eyy}$$

at rotation R*. For fractional values of rotation, the value of $Exy_R$ is approximated by interpolating the values of $Exy_R$ computed at integer values of rotation. A simple four tap interpolation filter is used. For example, $$Exy_R = 0.54(Exy_{R'} + Exy_{R'+1}) - 0.04^*(Exy_{R'-1} + Exy_{R'+2})$$

where R is a non-integral rotation (with precision of 0.5) and $R' = \lfloor R \rfloor$.

In a preferred embodiment, the rotational parameters are quantized for efficient transmission. The optimal gain b* is preferably quantized uniformly between 0.0625 and 4.0 as $$PGAIN = \max\left\{\min\left(\left\lfloor 63\left(\frac{b^* - 0.0625}{4 - 0.0625}\right) + 0.5\right\rfloor, 63\right), 0\right\}$$

where PGAIN is the transmission code and the quantized gain $\hat{b}^*$ is given by $$\max\left\{0.0625 + \left(\frac{PGAIN(4 - 0.0625)}{63}\right), 0.0625\right\}.$$

The optimal rotation R* is quantized as the transmission code PROT, which is set to $2(R^* - E_{rot} + 8)$ if L<80, and $R^* - E_{rot} + 16$ where L≧80.

C. Encoding Codebook

Figure 14:
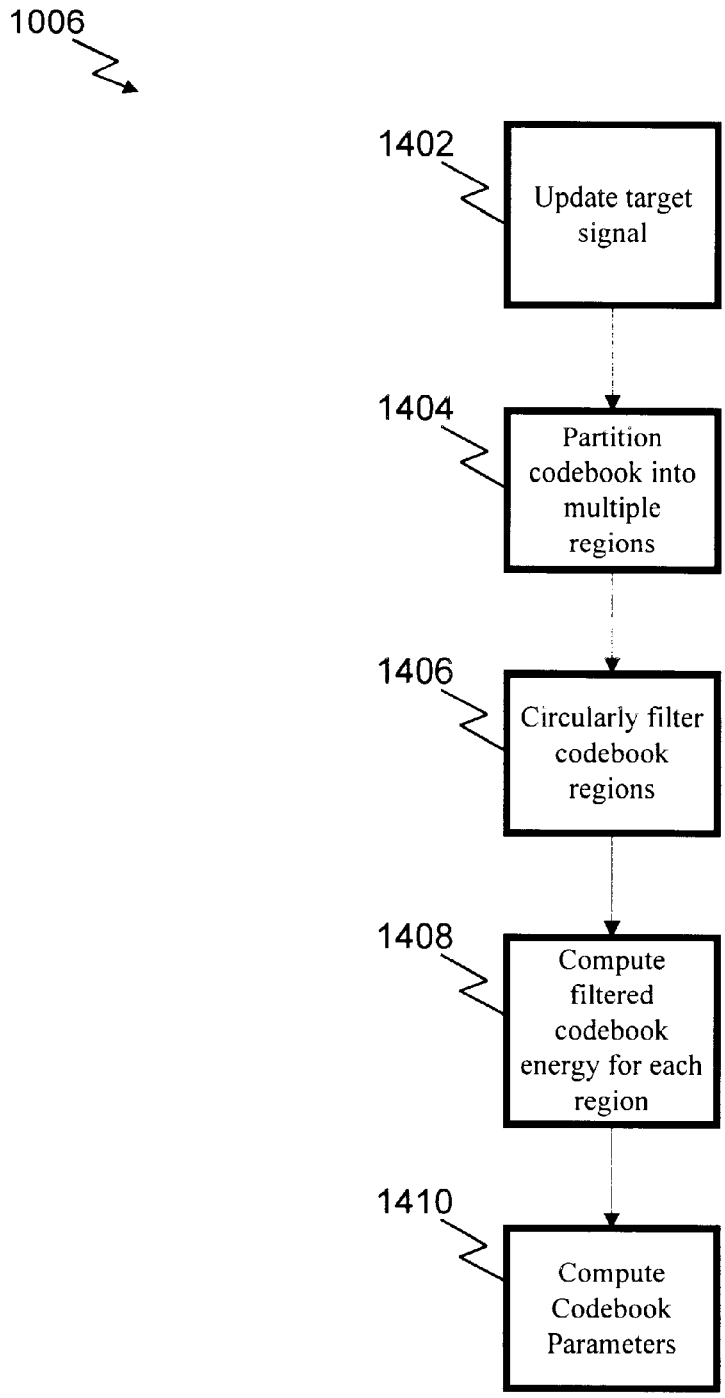
FIG. 14 is a flowchart depicting the operation of the encoding codebook.

Referring back to FIG. 10, in step 1006, encoding codebook 908 generates a set of codebook parameters based on the received target signal x(n). Encoding codebook 908 seeks to find one or more codevectors which, when scaled, added, and filtered sum to a signal which approximates x(n). In a preferred embodiment, encoding codebook 908 is implemented as a multi-stage codebook, preferably three stages, where each stage produces a scaled codevector. The set of codebook parameters therefore includes the indexes and gains corresponding to three codevectors. FIG. 14 is a flowchart depicting step 1006 in greater detail.

In step 1402, before the codebook search is performed, the target signal x(n) is updated as $$x(n) = x(n) - by((n - R^*)o/oL),\ 0 \le n < L$$

If in the above subtraction the rotation R* is non-integral (i.e., has a fraction of 0.5), then $$y(i-0.5) = -0.0073(y(i-4)+y(i+3)) + 0.0322(y(i-3)+y(i+2)) - 0.1363(y(i-2)+y(i+1)) + 0.6076(y(i-1)+y(i))$$

where $i = n - \lfloor R^* \rfloor$.

In step 1404, the codebook values are partitioned into multiple regions. According to a preferred embodiment, the codebook is determined as $$c(n) = \begin{cases} 1, & n = 0 \\ 0, & 0 < n < L \\ CBP(n-L), & L \le n < 128 + L \end{cases}$$

where CBP are the values of a stochastic or trained codebook. Those skilled in the art will recognize how these codebook values are generated. The codebook is partitioned into multiple regions, each of length L. The first region is a single pulse, and the remaining regions are made up of values from the stochastic or trained codebook. The number of regions N will be ⌈128/L⌉.

In step 1406, the multiple regions of the codebook are each circularly filtered to produce the filtered codebooks, $y_{reg}(n)$, the concatenation of which is the signal y(n). For each region, the circular filtering is performed as described above with respect to step 1302.

In step 1408, the filtered codebook energy, Eyy(reg), is computed for each region and stored:

$$Eyy(reg) = \sum_{i=0}^{L-1} y_{reg}(i),\quad 0 \le reg < N$$

In step 1410, the codebook parameters (i.e., codevector index and gain) for each stage of the multi-stage codebook are computed. According to a preferred embodiment, let Region(I)=reg, defined as the region in which sample I resides, or $$Region(I) = \begin{cases} 0, & 0 \le I < L \\ 1, & L \le I < 2L \\ 2, & 2L \le I < 3L \\ \ldots & \ldots \end{cases}$$

and let Exy(I) be defined as $$Exy(I) = \sum_{i=0}^{L-1} x(i)y_{Region(I)}((i+I)\%L)$$

The codebook parameters, I* and G*, for the $j^{th}$ codebook stage are computed using the following pseudo-code.

```
Exy* = 0, Eyy* = 0

for (I = 0 to 127){
        computeExy(I)
        if (Exy(I)√Eyy* > Exy*(I)√Eyy(Region(I))) {
        Exy* = Exy(I)
        Eyy* = Eyy(Region(I))
        I* = I}}
```

and $$G^* = \frac{Exy^*}{Eyy^*}.$$

According to a preferred embodiment, the codebook parameters are quantized for efficient transmission. The transmission code CBIj (j=stage number–0, 1 or 2) is preferably set to I* and the transmission codes CBGj and SIGNj are set by quantizing the gain G*.

$$SIGNj = \begin{cases} 0, & G^* \geq 0 \\ 1, & G^* < 0 \end{cases}$$

$$CBGj = \left\lfloor \min\{\max\{0, \log_2(|G^*|)\}, 11.25\}\frac{4}{3} + 0.5 \right\rfloor$$

and the quantized gain $\hat{G}^*$ is $$\hat{G}^* = \begin{cases} 2^{0.75CBGj} & SIGNj = 0 \\ -2^{0.75CBGj,} & SIGNj \neq 0 \end{cases}$$

The target signal x(n) is then updated by subtracting the contribution of the codebook vector of the current stage $$x(n)=x(n)-\hat{G}^* y_{Region(I^*)}((n+I^*)\%\ L), 0 \leqq n < L$$

The above procedures starting from the pseudo-code are repeated to computeI*, G*, and the corresponding transmission codes, for the second and third stages.

D. Filter Update Module

Figure 15A:
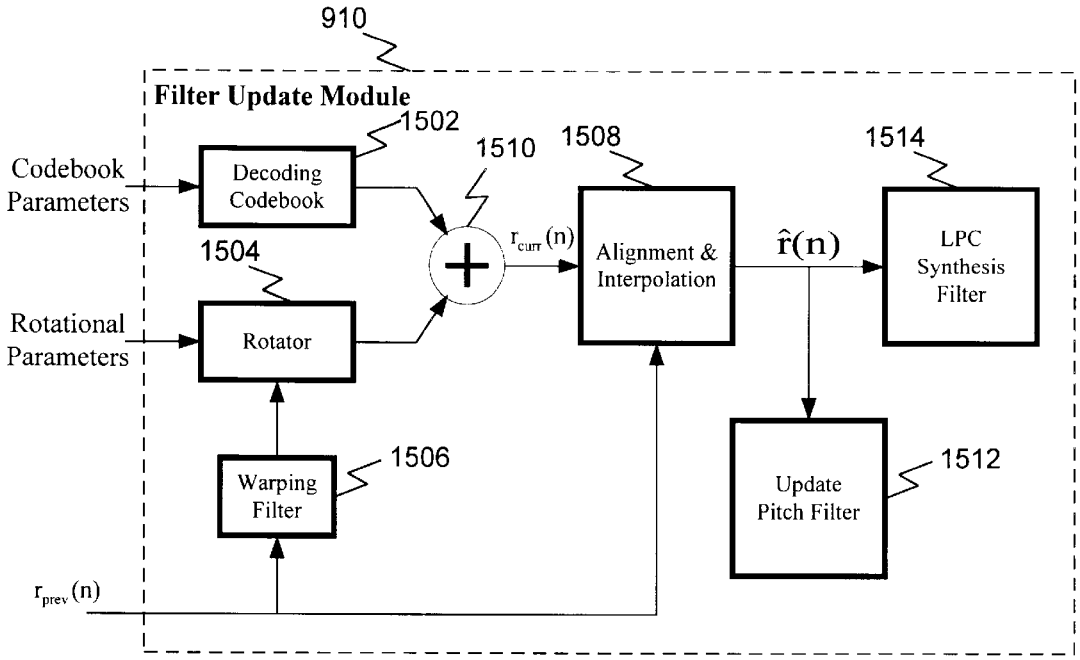
FIG. 15A depicts a first filter update module embodiment.
Figure 16A:
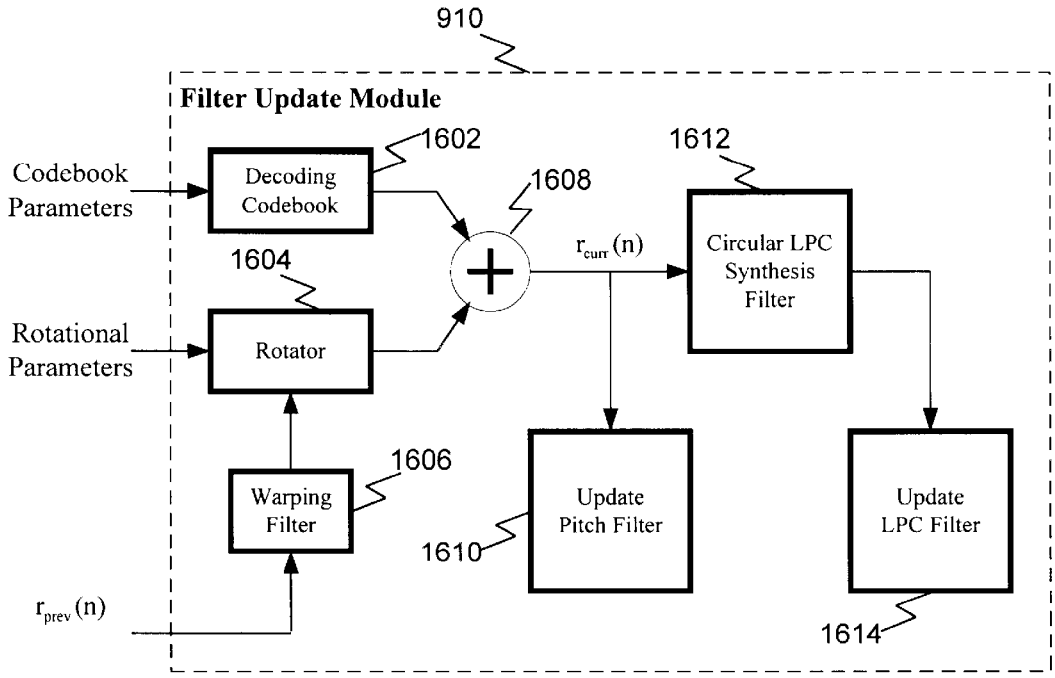
FIG. 16A depicts a second filter update module embodiment.
Figure 17:
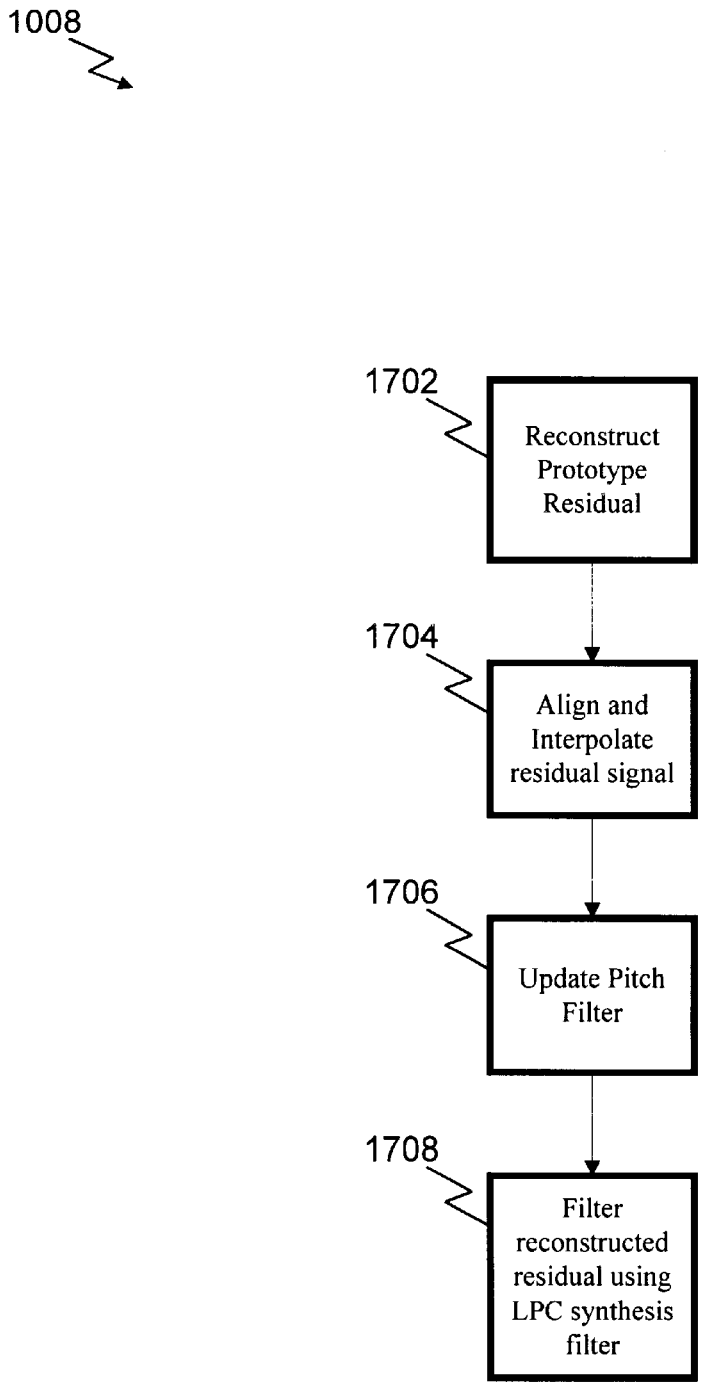
FIG. 17 is a flowchart describing the operation of the first filter update module embodiment.
Figure 18:
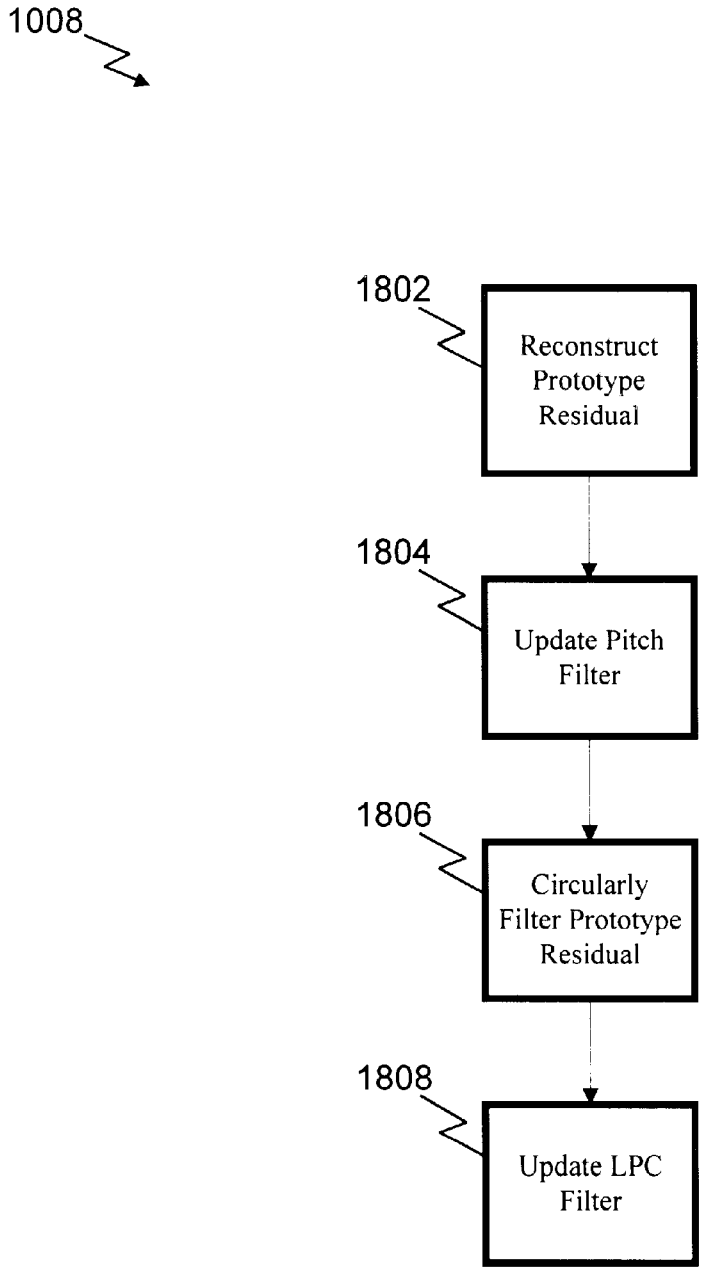
FIG. 18 is a flowchart describing the operation of the second filter update module embodiment.

Referring back to FIG. 10, in step 1008, filter update module 910 updates the filters used by PPP encoder mode 204. Two alternative embodiments are presented for filter update module 910, as shown in FIGS. 15A and 16A. As shown in the first alternative embodiment in FIG. 15A, filter update module 910 includes a decoding codebook 1502, a rotator 1504, a warping filter 1506, an adder 1510, an alignment and interpolation module 1508, an update pitch filter module 1512, and an LPC synthesis filter 1514. The second embodiment, as shown in FIG. 16A, includes a decoding codebook 1602, a rotator 1604, a warping filter 1606, an adder 1608, an update pitch filter module 1610, a circular LPC synthesis filter 1612, and an update LPC filter module 1614. FIGS. 17 and 18 are flowcharts depicting step 1008 in greater detail, according to the two embodiments.

In step 1702 (and 1802, the first step of both embodiments), the current reconstructed prototype residual, $r_{curr}(n)$, L samples in length, is reconstructed from the codebook parameters and rotational parameters. In a preferred embodiment, rotator 1504 (and 1604) rotates a warped version of the previous prototype residual according to the following:

$$r_{curr}((n+R^*)\%\ L)=b\ rw_{prev}(n), 0 \leqq < L$$

where $r_{curr}$ is the current prototype to be created, $rw_{prev}$ is the warped (as described above in Section VIII.A., with $$TWF = \frac{L_p}{L}\Big)$$

version of the previous period obtained from the most recent L samples of the pitch filter memories, b the pitch gain and R the rotation obtained from packet transmission codes as $$b = \max\left\{0.0625\left(\frac{PGAIN(4-0.0625)}{63}\right),\ 0.0625\right\}$$

$$R = \begin{cases} \frac{PROT}{2} + E_{rot} - 8, & L < 80 \\ PROT + E_{rot} - 16, & L \geq 80 \end{cases}$$

where $E_{rot}$ is the expected rotation computed as described above in Section VIII.B.

Decoding codebook 1502 (and 1602) adds the contributions for each of the three codebook stages to $r_{curr}(n)$ as $$r_{curr}((n--i)\%L) = r_{curr}((n-I)\%L) + \begin{cases} G, & I < L, n = 0 \\ GCBP(I-L+n), & I \geq L, 0 \leq n < L \end{cases}$$

where I=CBIj and G is obtained from CBGj and SIGNj as described in the previous section, j being the stage number.

Figure 19:
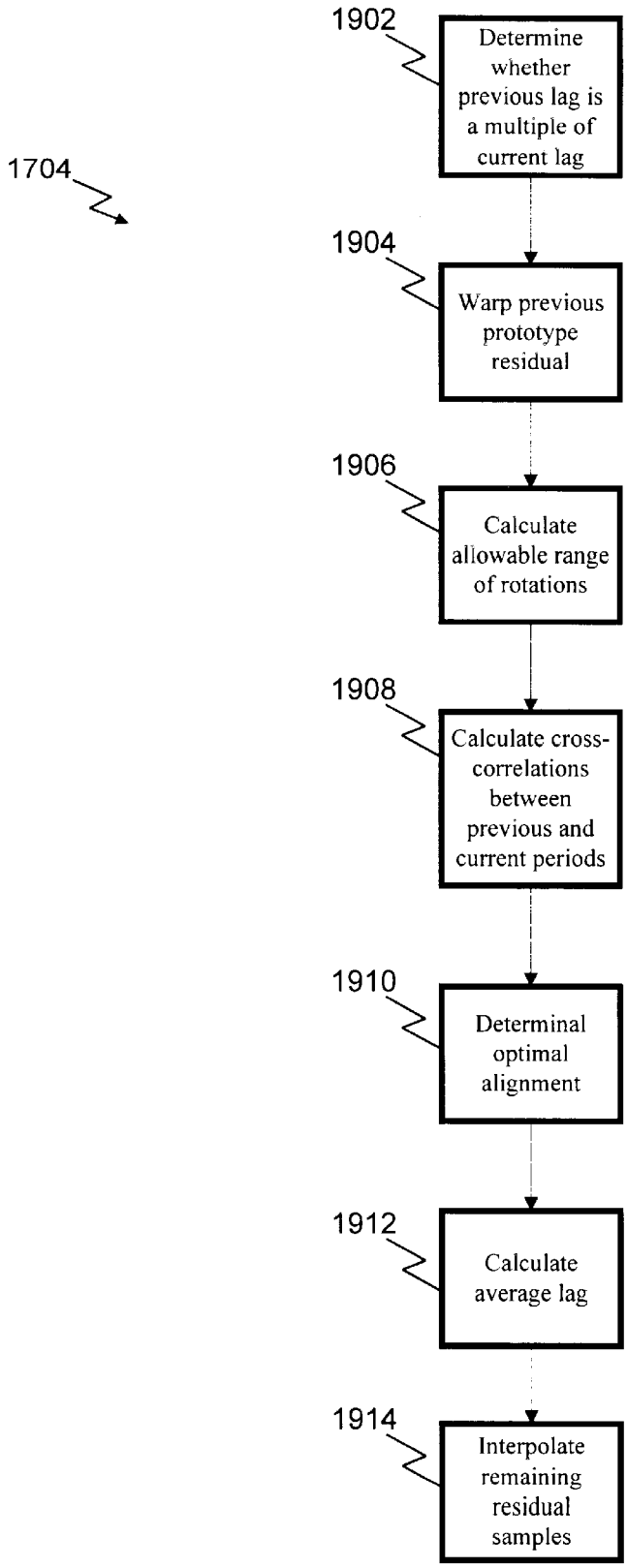
FIG. 19 is a flowchart describing the aligning and interpolating of prototype residual periods.

At this point, the two alternative embodiments for filter update module 910 differ. Referring first to the embodiment of FIG. 15A, in step 1704, alignment and interpolation module 1508 fills in the remainder of the residual samples from the beginning of the current frame to the beginning of the current prototype residual (as shown in FIG. 12 which is an illustration 1200 that depicts a prototype residual period extracted from the current frame of a residual signal, and the prototype residual period from the previous frame). Here, the alignment and interpolation are performed on the residual signal. However, these same operations can also be performed on speech signals, as described below. FIG. 19 is a flowchart describing step 1704 in further detail.

In step 1902, it is determined whether the previous lag $L_p$ is a double or a half relative to the current lag L. In a preferred embodiment, other multiples are considered too improbable, and are therefore not considered. If $L_p$>1.85L, $L_p$ is halved and only the first half of the previous period $r_{prev}(n)$ is used. If $L_p$<0.54L, the current lag L is likely a double and consequently $L_p$ is also doubled and the previous period $r_{prev}(n)$ is extended by repetition.

In step 1904, $r_{prev}(n)$ is warped to form $rw_{prev}(n)$ as described above with respect to step 1306, with $$TWF = \frac{L_p}{L},$$

so that the lengths of both prototype residuals are now the same. Note that this operation was performed in step 1702, as described above, by warping filter 1506. Those skilled in the art will recognize that step 1904 would be unnecessary if the output of warping filter 1506 were made available to alignment and interpolation module 1508.

In step 1906, the allowable range of alignment rotations is computed. The expected alignment rotation, $E_A$, is computed to be the same as $E_{rot}$ as described above in Section VIII.B. The alignment rotation search range is defined to be $\{E_A-\delta A, E_A-\delta A+0.5, E_A-\delta A+1, \ldots, E_A+\delta A-1.5, E_A+\delta A-1\}$, where $\delta A=\max\{6,0.15L\}$.

In step 1908, the cross-correlations between the previous and current prototype periods for integer alignment rotations, R, are computed as $$C(A) = \sum_{i=0}^{L-1} r_{curr}((i+A)\%L) rw_{prev}(i)$$

and the cross-correlations for non-integral rotations A are approximated by interpolating the values of the correlations at integral rotation:

$$C(A)=0.54(C(A')+C(A'+1))-0.04(C(A'-1)+C(A'+2))$$

where A'=A−0.5.

In step 1910, the value of A (over the range of allowable rotations) which results in the maximum value of C(A) is chosen as the optimal alignment, A*.

In step 1912, the average lag or pitch period for the intermediate samples, $L_{av}$, is computed in the following manner. A period number estimate, $N_{per}$, is computed as $$N_{per} = round\left(\frac{A^*}{L} + \frac{(160-L)(L_p+L)}{2L_pL}\right)$$

with the average lag for the intermediate samples given by $$L_{av} = \frac{(160-L)L}{N_{per}L - A^*}$$

In step 1914, the remaining residual samples in the current frame are calculated according to the following interpolation between the previous and current prototype residuals:

$$\hat{r}(n) = \begin{cases} \left(1 - \frac{n}{160-L}\right) rw_{prev}((n\alpha)\%L) \\ + \frac{n}{160-L} r_{curr}((n\alpha + A^*)\%L), & 0 \le n < 160-L \\ r_{curr}(n+L-160), & 160-L \le n < 160 \end{cases}$$

where $$\alpha = \frac{L}{L_{av}}.$$

The sample values at non-integral points $\tilde{n}$ (equal to either $n\alpha$ or $n\alpha+A^*$) are computed using a set of sinc function tables. The sinc sequence chosen is sinc(−3−F: 4−F) where F is the fractional part of $\tilde{n}$ rounded to the nearest multiple of $$\frac{1}{8}.$$

The beginning of this sequence is aligned with $r_{prev}((N-3)\%L_p)$ where N is the integral part of $\tilde{n}$ after being rounded to the nearest eighth.

Note that this operation is essentially the same as warping, as described above with respect to step 1306. Therefore, in an alternative embodiment, the interpolation of step 1914 is computed using a warping filter. Those skilled in the art will recognize that economies might be realized by reusing a single warping filter for the various purposes described herein.

Returning to FIG. 17, in step 1706, update pitch filter module 1512 copies values from the reconstructed residual $\hat{r}(n)$ to the pitch filter memories. Likewise, the memories of the pitch prefilter are also updated.

In step 1708, LPC synthesis filter 1514 filters the reconstructed residual $\hat{r}(n)$, which has the effect of updating the memories of the LPC synthesis filter.

The second embodiment of filter update module 910, as shown in FIG. 16A, is now described. As described above with respect to step 1702, in step 1802, the prototype residual is reconstructed from the codebook and rotational parameters, resulting in $r_{curr}(n)$.

In step 1804, update pitch filter module 1610 updates the pitch filter memories by copying replicas of the L samples from $r_{curr}(n)$, according to $$\text{pitch_mem}(i) = r_{curr}((L-(131\%L)+i)\%L),\ 0 \le i < 131$$

or alternatively, $$\text{pitch_mem}(131-1-i) = r_{curr}(L-1-i\%L), 0 \le i < 131$$

where 131 is preferably the pitch filter order for a maximum lag of 127.5. In a preferred embodiment, the memories of the pitch prefilter are identically replaced by replicas of the current period $r_{curr}(n)$:

$$\text{pitch_prefilt_mem}(i) = \text{pitch_mem}(i), 0 \le i < 131$$

In step 1806, $r_{curr}(n)$ is circularly filtered as described in Section VIII.B., resulting in $s_c(n)$, preferably using perceptually weighted LPC coefficients.

In step 1808, values from $s_c(n)$, preferably the last ten values (for a $10^{th}$ order LPC filter), are used to update the memories of the LPC synthesis filter.

E. PPP Decoder

Returning to FIGS. 9 and 10, in step 1010, PPP decoder mode 206 reconstructs the prototype residual $r_{curr}(n)$ based on the received codebook and rotational parameters. Decoding codebook 912, rotator 914, and warping filter 918 operate in the manner described in the previous section. Period interpolator 920 receives the reconstructed prototype residual $r_{curr}(n)$ and the previous reconstructed prototype residual $r_{prev}(n)$, interpolates the samples between the two prototypes, and outputs synthesized speech signal $\hat{s}(n)$. Period interpolator 920 is described in the following section.

F. Period Interpolator

Figure 15B:
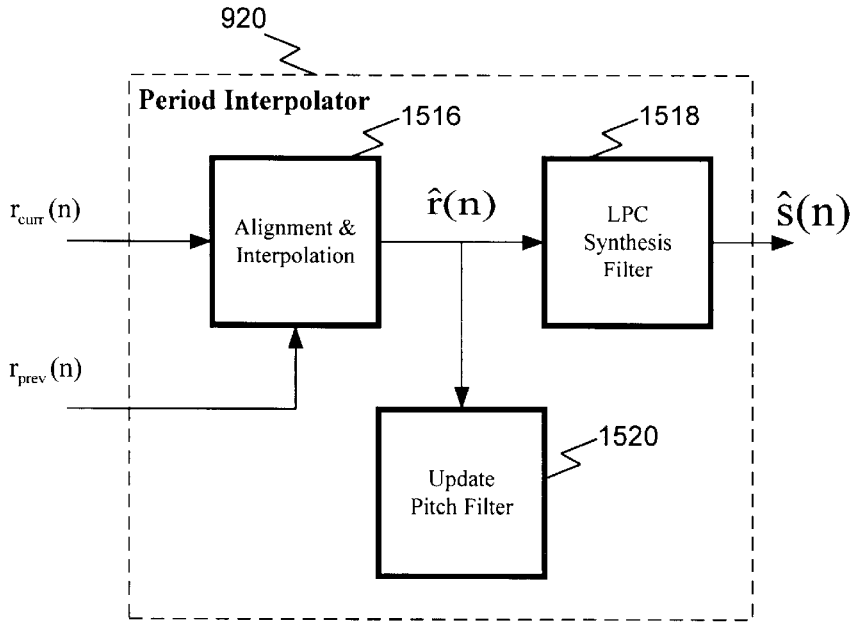
FIG. 15B depicts a first period interpolator module embodiment.
Figure 16B:
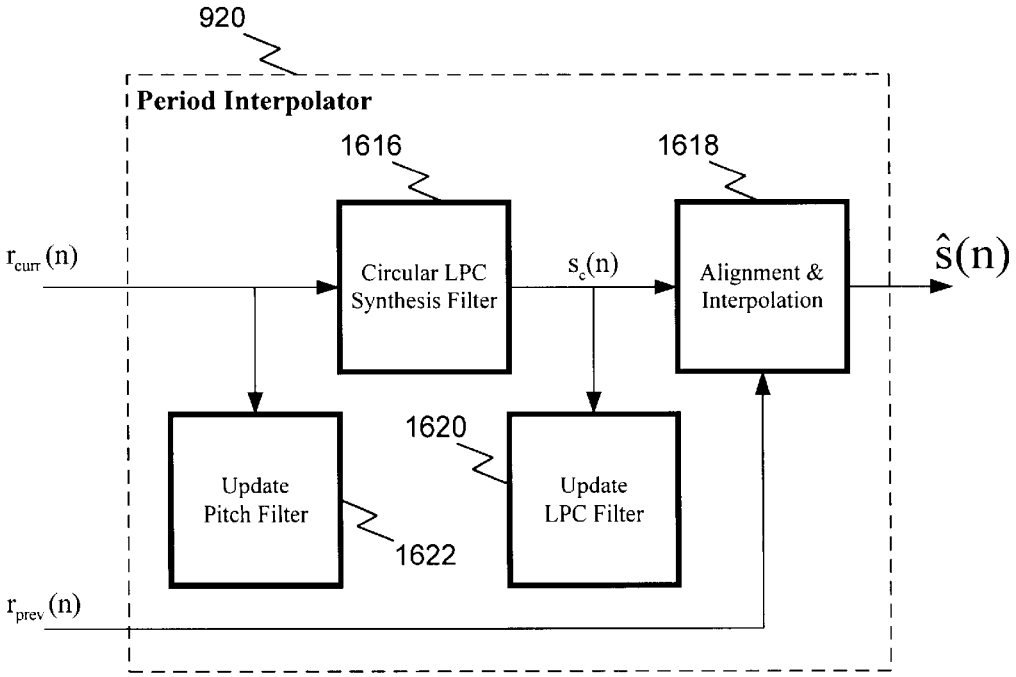
FIG. 16B depicts a second period interpolator module embodiment.
Figure 20:
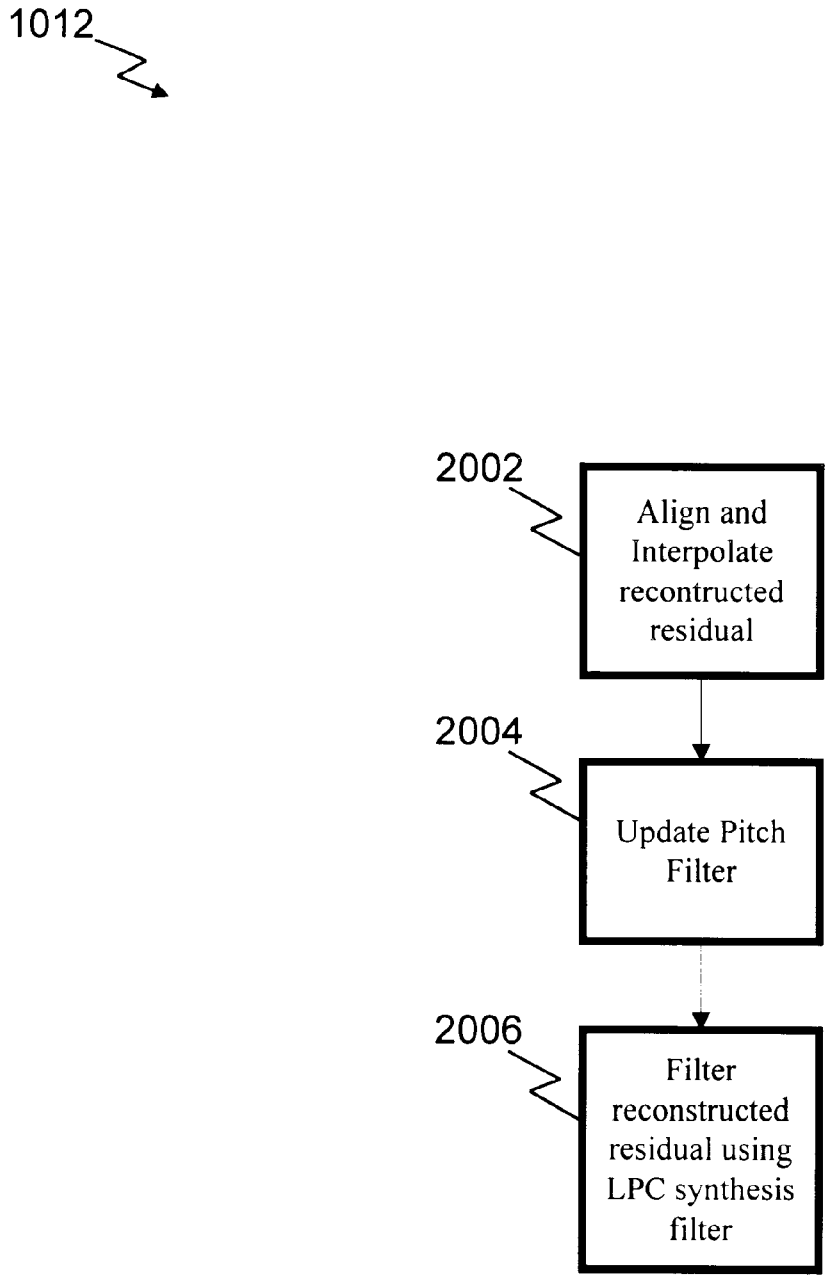
FIG. 20 is a flowchart describing the reconstruction of a speech signal based on prototype residual periods according to a first embodiment.
Figure 21:
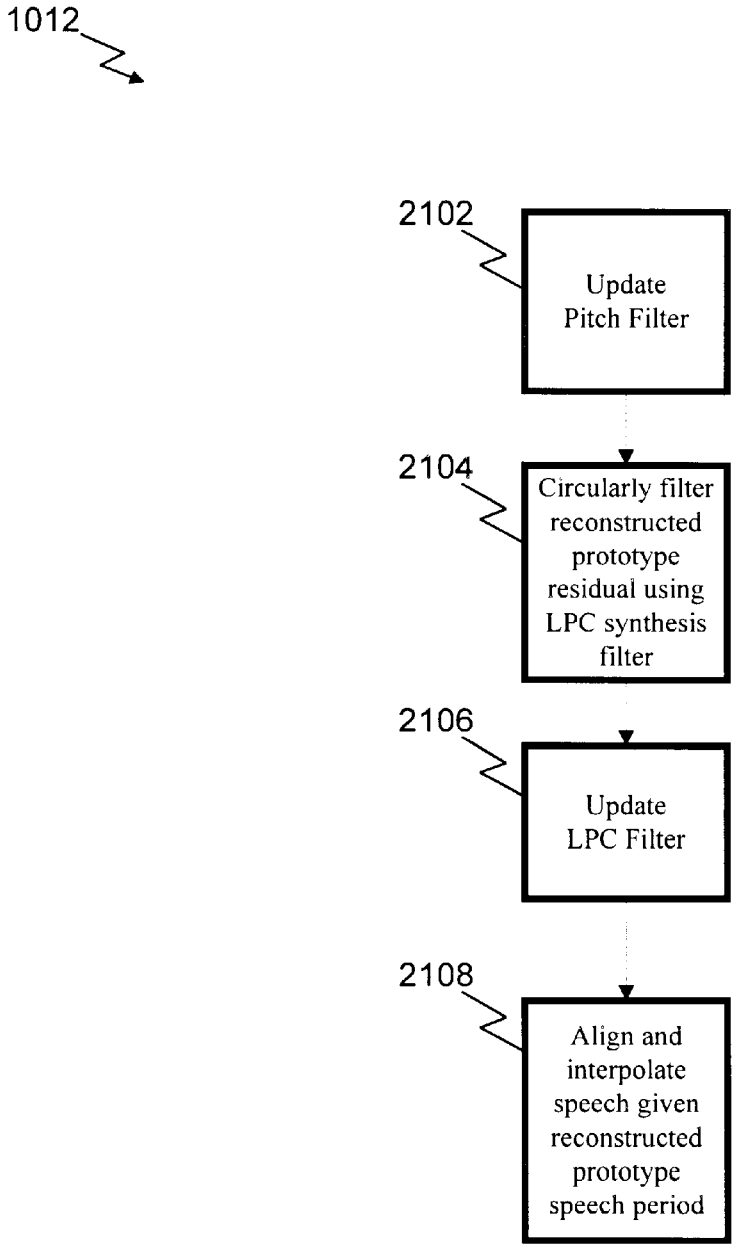
FIG. 21 is a flowchart describing the reconstruction of a speech signal based on prototype residual periods according to a second embodiment.

In step 1012, period interpolator 920 receives $r_{curr}(n)$ and outputs synthesized speech signal $\hat{s}(n)$. Two alternative embodiments for period interpolator 920 are presented herein, as shown in FIGS. 15B and 16B. In the first alternative embodiment, FIG. 15B, period interpolator 920 includes an alignment and interpolation module 1516, an LPC synthesis filter 1518, and an update pitch filter module 1520. The second alternative embodiment, as shown in FIG. 16B, includes a circular LPC synthesis filter 1616, an alignment and interpolation module 1618, an update pitch filter module 1622, and an update LPC filter module 1620. FIGS. 20 and 21 are flowcharts depicting step 1012 in greater detail, according to the two embodiments.

Referring to FIG. 15B, in step 2002, alignment and interpolation module 1516 reconstructs the residual signal for the samples between the current residual prototype $r_{curr}(n)$ and the previous residual prototype $r_{prev}(n)$, forming $\hat{r}(n)$. Alignment and interpolation module 1516 operates in the manner described above with respect to step 1704 (as shown in FIG. 19).

In step 2004, update pitch filter module 1520 updates the pitch filter memories based on the reconstructed residual signal $\hat{r}(n)$, as described above with respect to step 1706.

In step 2006, LPC synthesis filter 1518 synthesizes the output speech signal $\hat{s}(n)$ based on the reconstructed residual signal $\hat{r}(n)$. The LPC filter memories are automatically updated when this operation is performed.

Referring now to FIGS. 16B and 21, in step 2102, update pitch filter module 1622 updates the pitch filter memories based on the reconstructed current residual prototype, $r_{curr}(n)$, as described above with respect to step 1804.

In step 2104, circular LPC synthesis filter 1616 receives $r_{curr}(n)$ and synthesizes a current speech prototype, $s_c(n)$ (which is L samples in length), as described above in Section VIII.B.

In step 2106, update LPC filter module 1620 updates the LPC filter memories as described above with respect to step 1808.

In step 2108, alignment and interpolation module 1618 reconstructs the speech samples between the previous prototype period and the current prototype period. The previous prototype residual, $r_{prev}(n)$, is circularly filtered (in an LPC synthesis configuration) so that the interpolation may proceed in the speech domain. Alignment and interpolation module 1618 operates in the manner described above with respect to step 1704 (see FIG. 19), except that the operations are performed on speech prototypes rather than residual prototypes. The result of the alignment and interpolation is the synthesized speech signal ŝ(n).

IX. Noise Excited Linear Prediction (NELP) Coding Mode

Noise Excited Linear Prediction (NELP) coding models the speech signal as a pseudo-random noise sequence and thereby achieves lower bit rates than may be obtained using either CELP or PPP coding. NELP coding operates most effectively, in terms of signal reproduction, where the speech signal has little or no pitch structure, such as unvoiced speech or background noise.

Figure 22A:
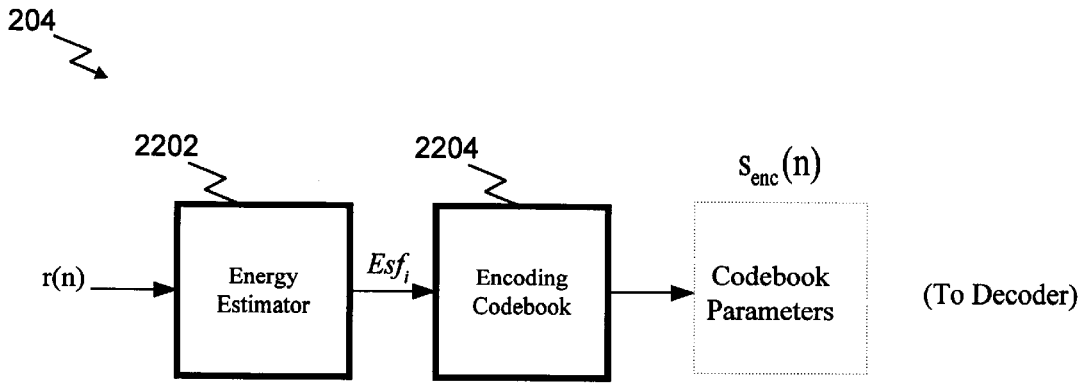
FIG. 22A depicts a NELP encoder.
Figure 22B:
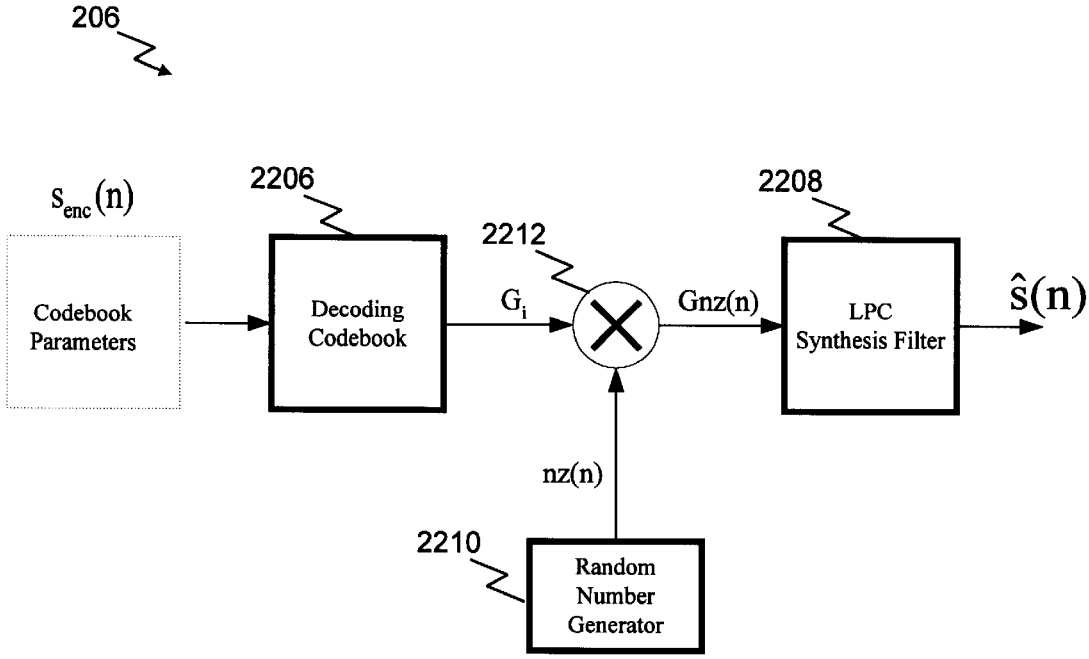
FIG. 22B depicts a NELP decoder.

FIG. 22 depicts a NELP encoder mode 204 and a NELP decoder mode 206 in further detail. NELP encoder mode 204 includes an energy estimator 2202 and an encoding codebook 2204. NELP decoder mode 206 includes a decoding codebook 2206, a random number generator 2210, a multiplier 2212, and an LPC synthesis filter 2208.

Figure 23:
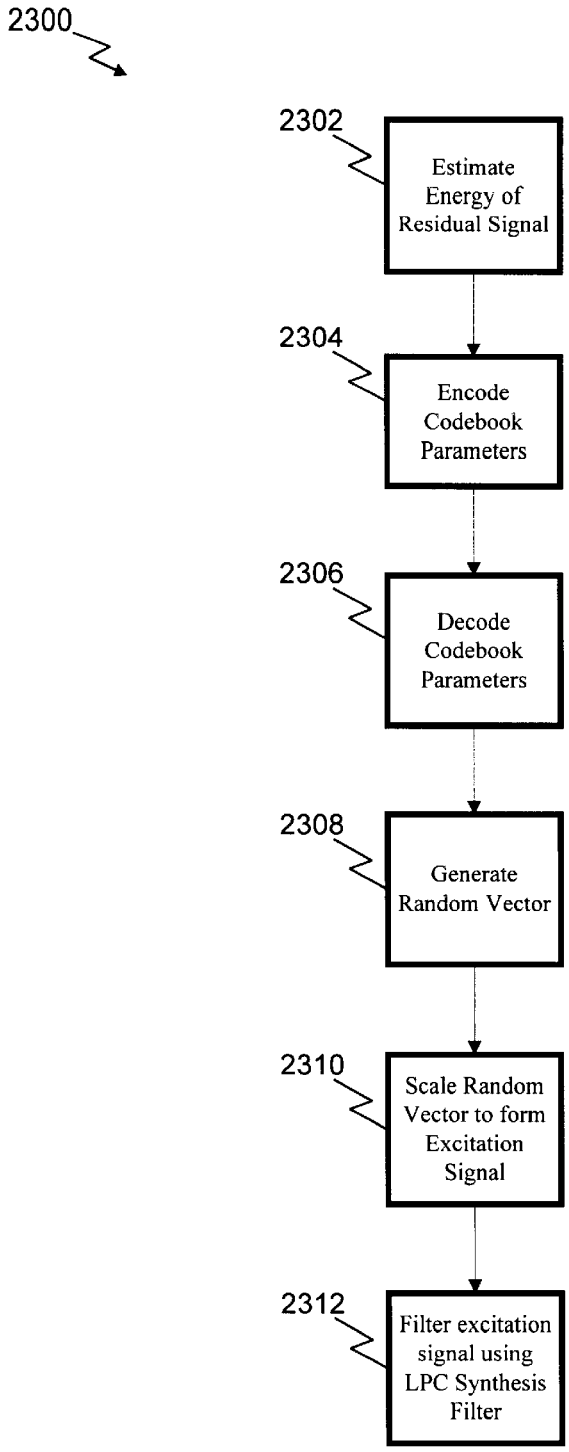
FIG. 23 is a flowchart describing NELP coding.

FIG. 23 is a flowchart 2300 depicting the steps of NELP coding, including encoding and decoding. These steps are discussed along with the various components of NELP encoder mode 204 and NELP decoder mode 206.

In step 2302, energy estimator 2202 calculates the energy of the residual signal for each of the four subframes as $$Esf_i = 0.5\log_2\left(\frac{\sum_{n=40i}^{40i+39} s^2(n)}{40}\right), \quad 0 \le i < 4$$

In step 2304, encoding codebook 2204 calculates a set of codebook parameters, forming encoded speech signal $s_{enc}$(n). In a preferred embodiment, the set of codebook parameters includes a single parameter, index I0. Index I0 is set equal to the value of j which minimizes $$\sum_{i=0}^{3}(Esf_i - SFEQ(j, i))^2 \quad \text{where } 0 \le j < 128$$

The codebook vectors, SFEQ, are used to quantize the subframe energies $Esf_I$ and include a number of elements equal to the number of subframes within a frame (i. e., 4 in a preferred embodiment). These codebook vectors are preferably created according to standard techniques known to those skilled in the art for creating stochastic or trained codebooks.

In step 2306, decoding codebook 2206 decodes the received codebook parameters. In a preferred embodiment, the set of subframe gains $G_I$ is decoded according to:

$$G_i = 2^{SFEQC(I0,i)},$$

or $$G_i 2^{0.2SFEQ(I0,i),+0.8\log_2 Gprev-2} \text{(where the previous frame was coded using a zero-rate coding scheme)}$$

where 0≦i<4 and Gprev is the codebook excitation gain corresponding to the last subframe of the previous frame.

In step 2308, random number generator 2210 generates a unit variance random vector nz(n). This random vector is scaled by the appropriate gain Gi within each subframe in step 2310, creating the excitation signal $G_i$nz(n).

In step 2312, LPC synthesis filter 2208 filters the excitation signal $G_i$nz(n) to form the output speech signal, ŝ(n).

In a preferred embodiment, a zero rate mode is also employed where the gain $G_i$ and LPC parameters obtained from the most recent non-zero-rate NELP subframe are used for each subframe in the current frame. Those skilled in the art will recognize that this zero rate mode can effectively be used where multiple NELP frames occur in succession.

X. Conclusion

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

The previous description of the preferred embodiments is provided to enable any person skilled in the art to make or use the present invention. While the invention has been particularly shown and described with reference to preferred embodiments thereof, it will be understood by those skilled in the art that various changes in form and details may be made therein without departing from the spirit and scope of the invention.

What is claimed is:

1. A method for the variable rate coding of a speech signal, comprising:

classifying the speech signal as either active or inactive, wherein classifying speech as active or inactive comprises a two energy band based thresholding scheme;

classifying said active speech into one of a plurality of woes of active speech, wherein said plurality of types of active speech include voiced, unvoiced, and transient speech;

selecting an encoder mode based on whether the speech signal is active or inactive, and if active, based further on said type of active speech, wherein said selected encoder mode is characterized by either a coding bit rate or a coding algorithm, or by a coding bit rate and a coding algorithm; and encoding the speech signal according to said encoder mode, forming an encoded speech signal.

2. A method for the variable rate coding of a speech signal, comprising:

classifying the speech signal as either active or inactive, wherein classifying speech as active or inactive comprises classifying the next M frames as active if the previous $N_{ho}$ frames were classified as active;

classifying said active speech into one of a plurality of types of active speech, wherein said plurality of types of active speech include voiced, unvoiced, and transient speech;

selecting an encoder mode based on whether the speech signal is active or inactive, and if active, based further on said type of active speech, wherein said selected encoder mode is characterized by either a coding bit rate or a coding algorithm, or by a coding bit rate and a coding algorithm; and encoding the speech signal according to said encoder mode forming an encoded speech signal.

3. A variable rate coding system for coding a speech signal, comprising:

classification means for classifying the speech signal as active or inactive based on a two energy band thresholding scheme, and if active, for classifying the active speech as one of a plurality of types of active speech; and a plurality of encoding means for encoding the speech signal as an encoded speech signal, wherein said encoding means are dynamically selected to encode the speech signal based on whether the speech signal is active or inactive, and if active, based further on said type of active speech.

4. A variable race coding system for coding a speech signal, comprising:

classification means for classifying the speech signal as active or inactive, wherein said classification means classifies the next M frames as active if the previous $N_{ho}$ frames were classified as active, and if active, for classifying the active speech as one of a plurality of types of active speech; and a plurality of encoding means for encoding the speech signal as an encoded speech signal, wherein said encoding means are dynamically selected to encode the speech signal based on whether the speech signal is active or inactive, and if active, based further on said type of active speech.

* * * * *

UNITED STATES PATENT AND TRADEMARK OFFICE

CERTIFICATE OF CORRECTION

PATENT NO. : 6,691,084 B2
DATED : February 10, 2004
INVENTOR(S) : Sharath Manjunath and William Gardner It is certified that error appears in the above-identified patent and that said Letters Patent is hereby corrected as shown below:

Column 30,
Line 28, please delete “woes” and replace with -- types --

Signed and Sealed this

Eighth Day of June, 2004

JON W. DUDAS
*Acting Director of the United States Patent and Trademark Office*